US006772931B2

(12) United States Patent
Miller et al.

(10) Patent No.: US 6,772,931 B2
(45) Date of Patent: Aug. 10, 2004

(54) MAGAZINE ASSEMBLY FOR FASTENING TOOL

(75) Inventors: Keven E. Miller, Forest Hill, MD (US); John C. Funicello, Palm Bay, FL (US); Todd A. Hagan, Windsor, PA (US); Thomas E. Miller, Spring Grove, PA (US); Andrzej R. Wojcicki, Rosedale, MD (US); Glen V. Steinbrunner, Forest Hill, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/631,298

(22) Filed: Jul. 31, 2003

(65) Prior Publication Data

US 2004/0020966 A1 Feb. 5, 2004

Related U.S. Application Data

(60) Division of application No. 10/134,784, filed on Apr. 29, 2002, now Pat. No. 6,679,413, which is a continuation-in-part of application No. 10/072,603, filed on Feb. 7, 2002, now Pat. No. 6,609,646.

(60) Provisional application No. 60/267,359, filed on Feb. 8, 2001.

(51) Int. Cl.[7] ..... B25C 1/04

(52) U.S. Cl. ..... 227/120; 227/136

(58) Field of Search ..... 227/120, 109, 227/119, 135, 127, 136

(56) References Cited

U.S. PATENT DOCUMENTS

| | | | | |
|---|---|---|---|---|
| 2,857,596 A | | 10/1958 | Allen et al. | |
| 2,979,725 A | | 4/1961 | Wandel et al. | |
| 3,037,207 A | | 6/1962 | Pazan | |
| 3,042,924 A | | 7/1962 | Frosted | |
| 3,156,920 A | | 11/1964 | Mysiak | |
| 3,291,358 A | | 12/1966 | Rabelow et al. | |
| 3,732,784 A | | 5/1973 | Vogelei et al. | |
| 3,777,619 A | | 12/1973 | Bull | |
| 3,840,165 A | | 10/1974 | Howard | |
| 3,858,781 A | | 1/1975 | Obergfell et al. | |
| 4,197,974 A | | 4/1980 | Morton et al. | |
| 4,319,706 A | * | 3/1982 | Halstead | 227/126 |
| 4,378,084 A | | 3/1983 | Scala | |

(List continued on next page.)

FOREIGN PATENT DOCUMENTS

| | | |
|---|---|---|
| DE | 811 464 | 6/1951 |
| DE | 819 214 | 9/1951 |

(List continued on next page.)

OTHER PUBLICATIONS

Senco Power Fastening Systems 2003 brochure.

Senco AirFree Battery Powered Nailers 2002 brochure.

*Primary Examiner*—Scott A. Smith
(74) *Attorney, Agent, or Firm*—Harness, Dickey & Pierce, P.L.C.

(57) ABSTRACT

A magazine assembly for a fastening tool. The magazine assembly includes a feed mechanism having a fastener follower that includes a cam device. The feed mechanism also includes a cam follower which is employed to engage the cam device so that fasteners may be loaded into the magazine assembly. The cam follower alternately engages and disengages the cam device in response to movement of the fastener follower relative to the cam device. A method for operating a fastening tool is also provided.

42 Claims, 26 Drawing Sheets

U.S. PATENT DOCUMENTS 4,389,012 A * 6/1983 Grikis et al. ..... 227/120
4,466,555 A 8/1984 Yarnitsky et al.
4,474,492 A 10/1984 Fleitas
4,524,896 A * 6/1985 Morrell, Jr. ..... 227/126
4,549,681 A 10/1985 Yamamoto et al.
4,597,517 A 7/1986 Wagdy
4,624,401 A 11/1986 Gassner et al.
4,658,687 A 4/1987 Haas et al.
4,671,443 A 6/1987 Becht
4,809,900 A * 3/1989 Ingelsten et al. ..... 227/116
4,913,331 A 4/1990 Utsumi et al.
5,167,359 A 12/1992 Frommelt
5,186,208 A 2/1993 Hansen
5,263,842 A 11/1993 Fealey
5,297,713 A * 3/1994 Perra et al. ..... 227/123
5,433,367 A 7/1995 Liu
5,580,066 A 12/1996 Jairam
5,626,274 A * 5/1997 Shkolnikov et al. ..... 227/109
5,720,422 A 2/1998 Ichikawa et al.
5,785,228 A 7/1998 Fa et al.
5,975,399 A 11/1999 Oehri et al.
5,975,822 A 11/1999 Ruff
6,012,622 A 1/2000 Weinger et al.
6,056,181 A 5/2000 Chuang
6,149,046 A * 11/2000 Ho et al. ..... 227/8
6,189,759 B1 * 2/2001 Canlas et al. ..... 227/120
6,199,739 B1 3/2001 Mukoyama et al.
6,290,115 B1 9/2001 Chen
6,296,167 B1 10/2001 Jen
6,431,428 B1 * 8/2002 Chen ..... 227/120

FOREIGN PATENT DOCUMENTS

DE 1171 356 11/1958
DE 24 43 544 9/1974
DE 24 53 646 11/1974
DE 25 17 061 4/1975
DE 28 38 194 9/1978
DE 31 00 703 1/1981
DE 87 03 691 3/1987
DE 91 00 418 1/1991
EP 0 218 778 11/1990
EP 0 559 861 7/1995
EP 0 661 140 2/1998

* cited by examiner 820
406
98
780
778
60
408
700
532
530
940
172
528
524
526
580
522
520
652
180
654
518
46
174
542
722
514
556
512
766
720
866
514
270
800
664
48
10
696
698
702
152
410
100
398
396
810
690
692
612
504
672
660
782
776
574
184
172
680
550
676
552
670
650
662
774
762
850
610
662
862
860
434
760
502
744
770
920
764
730
732
746
554
434
544
664
546

MAGAZINE ASSEMBLY FOR FASTENING TOOL

CROSS-REFERENCE TO RELATED APPLICATIONS

This application is divisional application of U.S. patent application Ser. No. 10/134,784 filed Apr. 29, 2002, now U.S. Pat. No. 6,679,413, which is a continuation-in-part of U.S. patent application Ser. No. 10/072,603 filed Feb. 7, 2002, now U.S. Pat. No. 6,609,646, which claimed the benefit of U.S. Provisional Application No. 60/267,359, filed Feb. 8, 2001. Other features of the present invention are discussed and claimed in commonly assigned copending U.S. application Ser. No. 10/072,668 filed Feb. 7, 2002 now U.S. Pat. No. 6,648,202, and U.S. application Ser. No. 10/428,605 filed May 2, 2003, pending.

FIELD OF THE INVENTION

The present invention generally relates to a fastening tool for dispensing fasteners from a magazine assembly into a workpiece and more specifically to an improved magazine assembly for a fastening tool.

BACKGROUND OF THE INVENTION

A number of pneumatically operated devices have been developed for use in driving fasteners, such as staples and nails, into workpieces. These tools typically employ a magazine assembly for holding a plurality of the fasteners and feeding the fasteners into the nose of the tool prior to the installation of the fasteners into a workpiece.

Despite the wide spread use of such tools, several drawbacks have been noted. One such drawback concerns the difficulty in loading fasteners into the magazine assembly. Frequently, the known magazine assemblies employ a follower for guiding the fasteners in housing of the magazine assembly that requires both of a user's hands to reposition the follower from a loading position, which permits the fasteners to be loaded into the housing of the magazine assembly, to a free position wherein the follower urges the fasteners upwardly in the housing of the magazine assembly. Accordingly, such mechanisms are often times cumbersome to operate.

SUMMARY OF THE INVENTION

In one form, the present invention provides a magazine assembly for a fastening tool. The magazine assembly includes a magazine housing, which defines a follower housing portion with an upper end and a lower end, a follower structure that is at least partially disposed in the follower housing portion, a spring that biases the follower structure upwardly toward the upper end of the follower housing portion, and a catch having a first catch portion, which is associated with the follower structure, and a second catch portion, which is associated with the magazine housing. The catch is selectively operable in an engaged condition that maintains the follower structure in a predetermined position relative to the magazine housing. The catch is situated in the engaged condition in response to manually releasing the follower structure following an initial downwardly directed contact event to thereby permit the spring to bias the follower structure upwardly in the follower housing portion. The catch is changed from the engaged condition to an unengaged condition in response to a subsequent downwardly directed contact event with the follower structure.

In another form, the present invention provides a fastening tool assembly having a fastening tool and a magazine assembly that is configured to hold and progressively dispense a plurality of fasteners to the fastening tool. The magazine assembly includes a magazine housing, a follower structure, a spring and a catch. The magazine housing has a follower housing portion with an upper end and a lower end. The follower structure includes a follower body, which is at least partially disposed in the follower housing portion, and an actuating lever that extends from the magazine housing and is configured to receive a manual input from a finger of a user to cause the follower body to translate downwardly in the follower housing portion. The spring is associated with the magazine housing and the follower structure and configured to bias the follower structure upwardly toward the upper end of the follower housing portion. The catch includes a first catch portion, which is coupled to the follower body, and a second catch portion, which is associated with the magazine housing. The catch is operable in an unlatched condition, which does not inhibit upward translating movement of the follower structure relative to the magazine housing, and a latched condition in which the first and second catch portions engage one another to inhibit the follower body from moving upwardly in the follower housing portion. The user need only press the actuating lever downward to cause the follower structure to translate downward relative to the magazine housing beyond a predetermined point and thereafter release the actuating lever to change the catch from the latched condition to the unlatched condition.

In another form, the present invention provides a fastening tool assembly having a fastening tool and a magazine assembly that is configured to hold and progressively dispense a plurality of fasteners to the fastening tool. The magazine assembly includes a magazine housing, a guide tab, a first catch portion, a second catch portion and a spring. The magazine housing is configured to hold the fasteners and has a follower housing portion with an upper end and a lower end. The guide tab is at least partially housed in the magazine housing and is configured to guide the fasteners while they are being progressively dispensed from the magazine housing. The first catch portion is coupled to one of the magazine housing and the follower structure, while the second catch portion being coupled to the other one of the magazine housing and the follower structure. The spring biases at least one of the first catch portion and the second catch portion away from the other one of the first catch portion and the second catch portion. The first catch portion and the second catch portion cooperate with one another to permit the guide tab to be latched in a loading position whereby the fasteners may be loaded into the magazine housing. The first catch portion and the second catch portion are configured such that their engagement is effected through relative translation of one of the first catch portion and the second catch portion toward the other one of the first catch portion and the second catch portion followed by relative translation of the one of the first catch portion and the second catch portion away from the other one of the first catch portion and the second catch portion. The first catch portion and the second catch portion are further configured such that disengagement of the first catch portion and the second catch portion from one another is effected solely through translation of the one of the first catch portion and the second catch portion toward the other one of the first catch portion and the second catch portion followed by relative translation of the one of the first catch portion and the second catch portion away from the other one of the first catch portion and the second catch portion.

In yet another form, the present invention provides a fastening tool assembly having a fastening tool and a magazine assembly. The magazine assembly is configured to hold a plurality of fasteners and progressively dispense the fasteners to the fastening tool. The magazine assembly includes a magazine housing, a guide tab, which is movably disposed in the magazine housing, and a catch for selectively securing the guide tab relative to the magazine housing in a loading position that permits one or more fasteners to be loaded into the magazine housing. The catch is solely responsive to translation of the guide tab within the magazine housing to latch the guide tab into the loading position and unlatch the guide tab from the loading position.

In another form, the present invention provides a method for operating a fastening tool assembly having a fastening tool and a magazine assembly. The magazine assembly includes a magazine housing, a guide tab, a spring and a catch. The guide tab is at least partially disposed in the magazine housing and biased upwardly therein via the spring. The catch is operable in an engaged condition for holding the guide tab in a position that permits a plurality of fasteners to be loaded into the magazine housing. The catch is also operable in a disengaged condition that does not inhibit upward movement of the guide tab in the magazine housing. The method includes: pushing the guide tab to a predetermined point at a lower end of the magazine housing; releasing the guide tab so that the spring lifts the guide tab upwardly from the predetermined point to engage the catch; loading the plurality of fasteners into the magazine housing; pushing the guide tab toward the lower end of the magazine housing to disengage the catch; and releasing the guide tab to permit the spring to raise the guide tab toward the upper end of the magazine housing.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENTS

Figure 1:
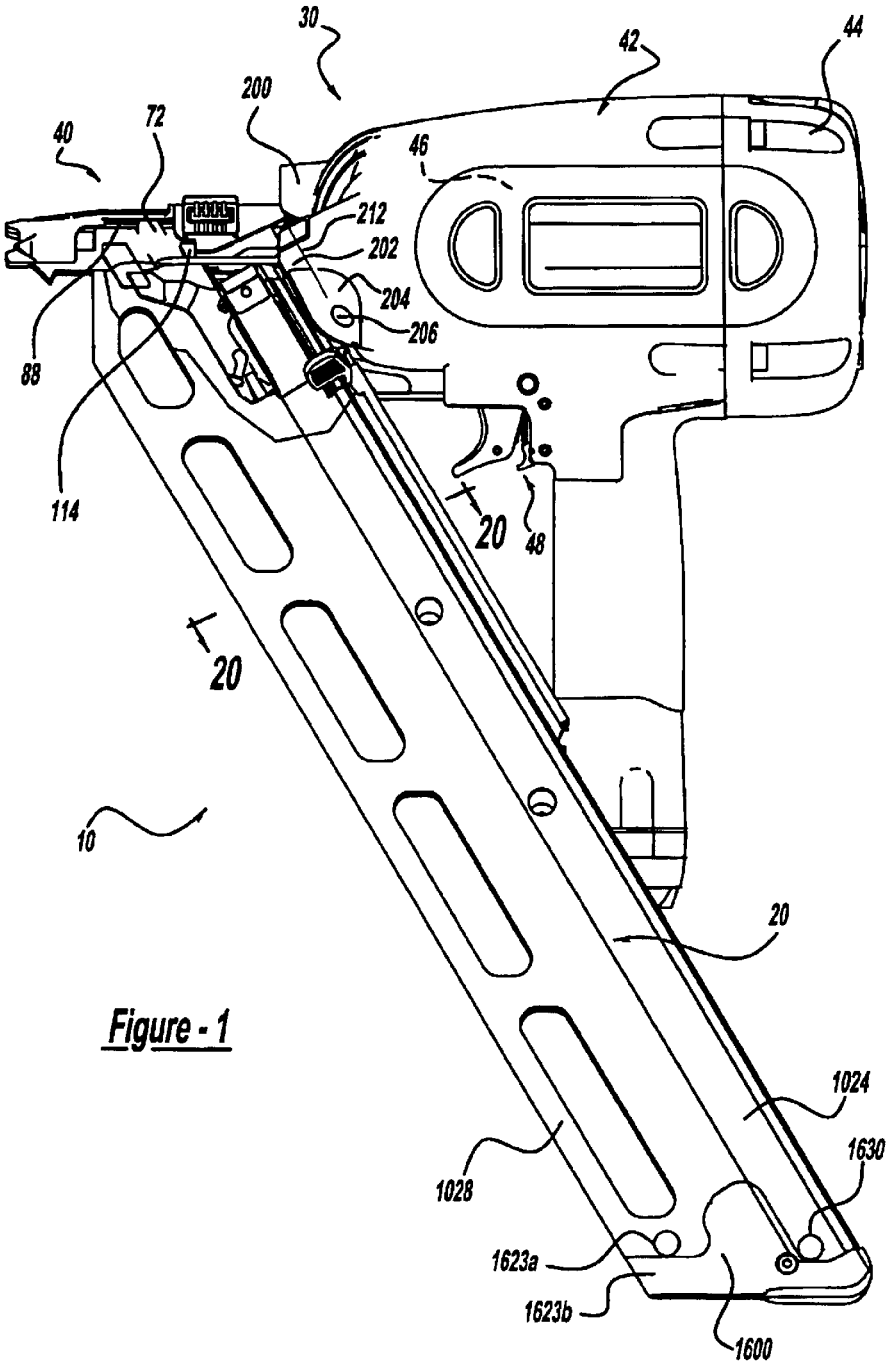
FIG. 1 is a left side view of a tool constructed in accordance with the teachings of a preferred embodiment of the present invention.
Figure 2:
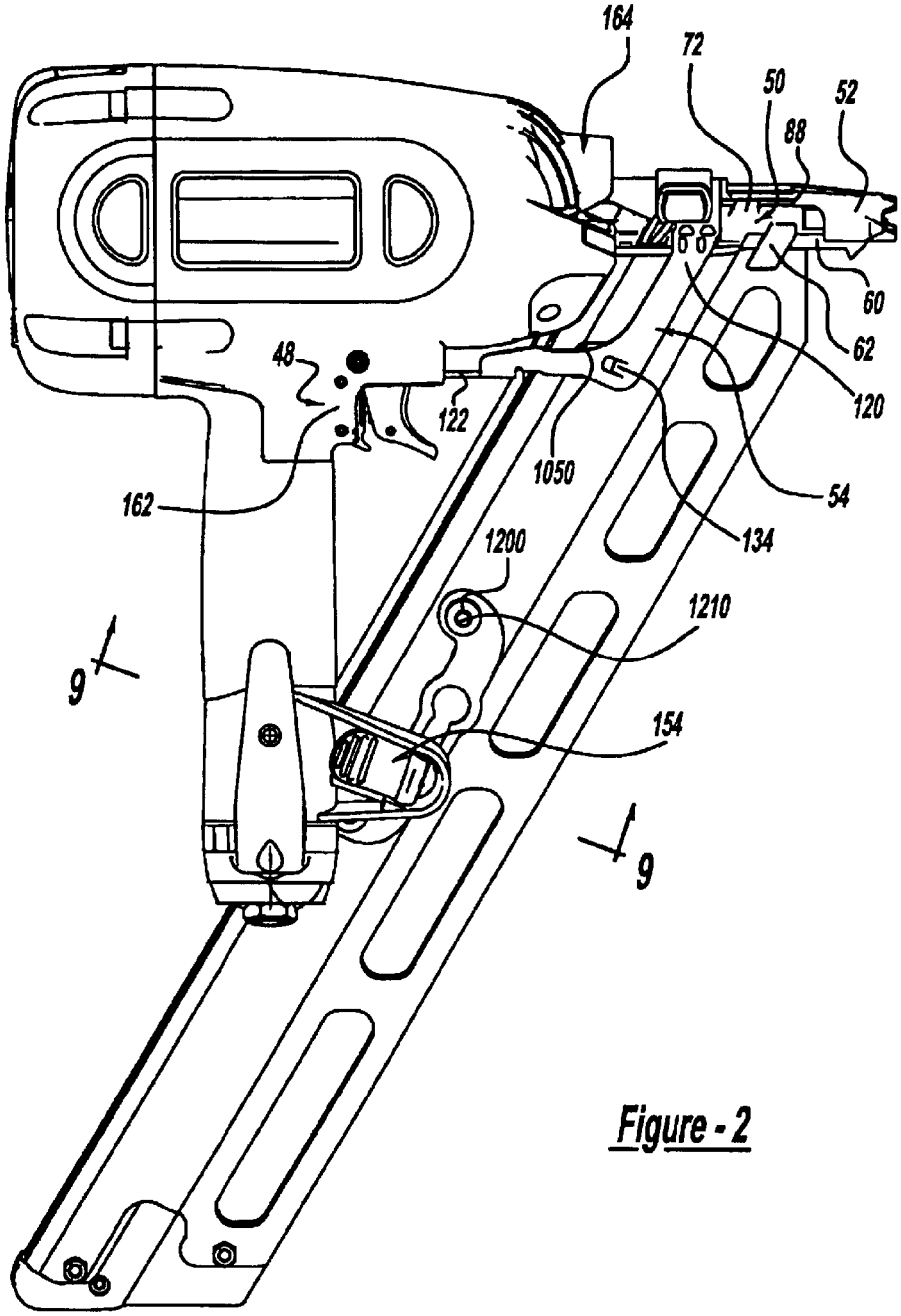
FIG. 2 is a right side view of the tool of FIG. 1.
Figure 3:
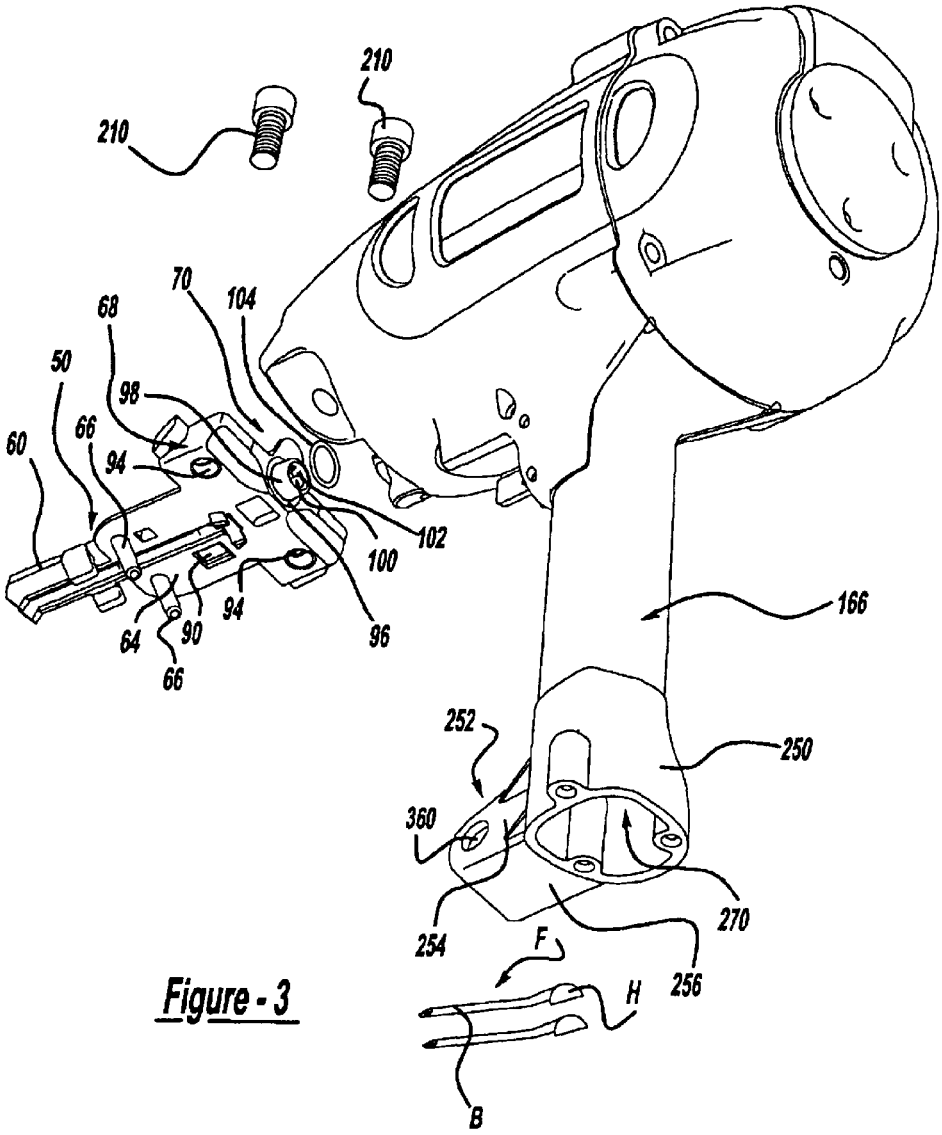
FIG. 3 is an exploded perspective view of the tool of FIG. 1.

With reference to FIG. 1 of the drawings, a fastening tool constructed in accordance with the teachings of the present invention is generally indicated by reference numeral 10. Fastening tool 10 is illustrated to include a detachable magazine assembly 20 and a fastening tool portion 30. The fastening tool portion 30 includes a nose assembly 40, a housing assembly 42, a cap assembly 44, an engine assembly 46 and a trigger assembly 48.

Nose Assembly

With reference to FIGS. 1 through 9, the nose assembly 40 is illustrated to include a nose structure 50, a contact trip 52, a trigger lever 54 and a contact trip-return spring 56. The nose structure 50 includes a nose body 60, a pair of magazine stabilizing tabs 62, a magazine flange 64, a pair of magazine guide posts 66, a mounting base 68, a spring post 70 and a pair of contact trip guides 72. The nose body 60 is generally U-shaped, with the legs 80 of the "U" being inwardly offset to form a semi-circular blade cavity 82. The inwardly offset legs 80 of the nose body 60 also serve as a guide surface 84 for guiding the lower front portion 86 of the contact trip 52. The contact trip guides 72 are coupled to the top of the nose body 60 and form a guide surface for guiding the portion 88 of the contact trip 52 that extends over the nose body 60.

The magazine stabilizing tabs 62 are situated on opposite sides of the nose body 60 and are spaced apart by a predetermined distance. The magazine flange 64 is a generally flat structure that is coupled to the bottom of the nose body 60 and that includes a lock-out dog aperture 90. The magazine guide posts 66, which are cylindrically shaped in the particular embodiment illustrated, extend downwardly and rearwardly from the magazine flange 64. The magazine stabilizing tabs 62, magazine flange 64 and magazine guide posts 66 are discussed in greater detail, below.

The mounting base 68 is coupled to the magazine flange 64 and the nose body 60 and includes a pair of mounting apertures 94, a nose seal groove 96 and a nose guide 98. The nose guide 98 is generally cylindrically shaped and includes an internal cavity 100 that having a cross-section that is configured to receive the fastener F and which may include a fastener stop 102 which is configured to prevent the fasteners F from traveling rearwardly toward the engine assembly 46. In the embodiment illustrated, the internal cavity 100 is generally semi-circular in shape but which includes a key-shaped fastener stop 102. The nose seal groove 96 is formed around the outer perimeter of the nose guide 98 and is sized to receive a nose seal 104, which is an O-ring seal in the particular embodiment illustrated. The spring post 70 is coupled to the top of the mounting base 68 and includes a boss 108 that is sized to fit within the contact trip-return spring 56.

The contact trip 52 is fit over and slides on the nose body 60, being guided thereon by the inwardly offset legs 80 of the nose body 60 and the contact trip guides 72. Preferably, the effective length of the contact trip 52 is adjustable so as to permit the tool operator to vary the depth at which the tool 10 sets the fasteners F. A spring protrusion 110, which is sized to engage the inside diameter of the contact trip-return spring 56, is formed in the rear of the contact trip 52. The contact trip-return spring 56 is set over the boss 108 on the spring post 70 and the spring protrusion 110 on the contact trip 52 and exerts a spring force that biases the contact trip 52 away from the spring post 70. Forward motion of the contact trip 52 is checked by a contract trip stop 114 that is formed onto a side of the nose body 60 and which contacts the contact trip 52 at a predetermined point.

The trigger lever 54 is fixedly coupled to the contact trip 52 at a first end 120 and extends rearwardly from the nose structure 50 where a second end 122 engages the trigger assembly 48 in a conventional manner that is well known in the art. Briefly, the trigger assembly 48 includes a primary trigger 126, a secondary trigger 128 and a trigger valve 130 that selectively controls the flow of compressed air to the engine assembly 46. The primary trigger 126 is pivotably mounted to the housing assembly 42 and movable in response to the tool operator's finger. Movement of the primary trigger 126 will not, in and of itself, alter the state of the trigger valve 130. Rather, the second end 122 of the trigger lever 54 must also move rearwardly and into contact with the secondary trigger 128 before the state of the trigger valve 130 is changed to permit compressed air to flow to the engine assembly 46. A stop member 134, which is configured to interact with the magazine assembly 20 in a matter that will be discussed in greater detail below, is coupled to the trigger lever 54 below the magazine flange 64 and extends inwardly toward the nose body 60. In the particular embodiment illustrated, the stop member 134 is die-punched into the trigger lever 54 and is offset inwardly therefrom toward the nose body 60.

Housing Assembly

Housing assembly 42 includes a unitarily formed housing 150, a piston bumper 152, a magazine clamp assembly 154 and a housing seal 156, which is illustrated to be an O-ring seal in the example provided. The housing 150 includes a housing body 160, a trigger housing 162, a nose housing 164 and a handle portion 166. The housing body 160 is a container-like structure having a front base 170 and an outwardly tapering sidewall 172 that cooperate to form a housing cavity 174. The outwardly tapering sidewall 172 terminates at the rear of the housing body 160 at a rear housing face 176, which in the particular embodiment illustrated, includes a housing seal groove 178 that is configured to receive the housing seal 156. A guide bore 180 is formed into the inside face 182 of the housing cavity 174 and terminates at its forward end at a guide stop 184. A nose guide aperture 188 is formed through the front base 170 of the housing body 160.

The nose housing 164 is coupled to the front base 170 of the housing body 160 and extends forwardly therefrom. The nose housing 164 includes an upper shroud 200, a pair of sidewalls 202 and a pair of spaced apart bosses 204, each of which having a threaded aperture 206. The upper shroud 200, sidewalls 202 and spaced apart bosses 204 cooperate to locate the nose assembly 40 to the housing 150 and the nose guide 98 is inserted into the nose guide aperture 188. Threaded fasteners 210 are placed through each of the mounting apertures 94 in the mounting base 68 and threadably engaged to the threaded apertures 206 in the spaced apart bosses 204 to fixedly but removably couple the nose assembly 40 to the housing 150. The axis 212 of the threaded fasteners 210 is skewed toward the rear of the tool 10, causing the threaded fasteners 210 to exert a clamping force that pushes the nose assembly 40 downwardly onto the spaced apart bosses 204 and rearwardly against the front face of the front base 170 to thereby compress the nose seal 104 and sealingly engage the nose structure 50 to the housing body 160. The upper shroud covers the spring post 70, the contact trip-return spring 56 and a portion of the rear of the contact trip 52 to prevent foreign objects from lodging between the rear of the contact trip 52 and the spring post 70.

Figure 4:
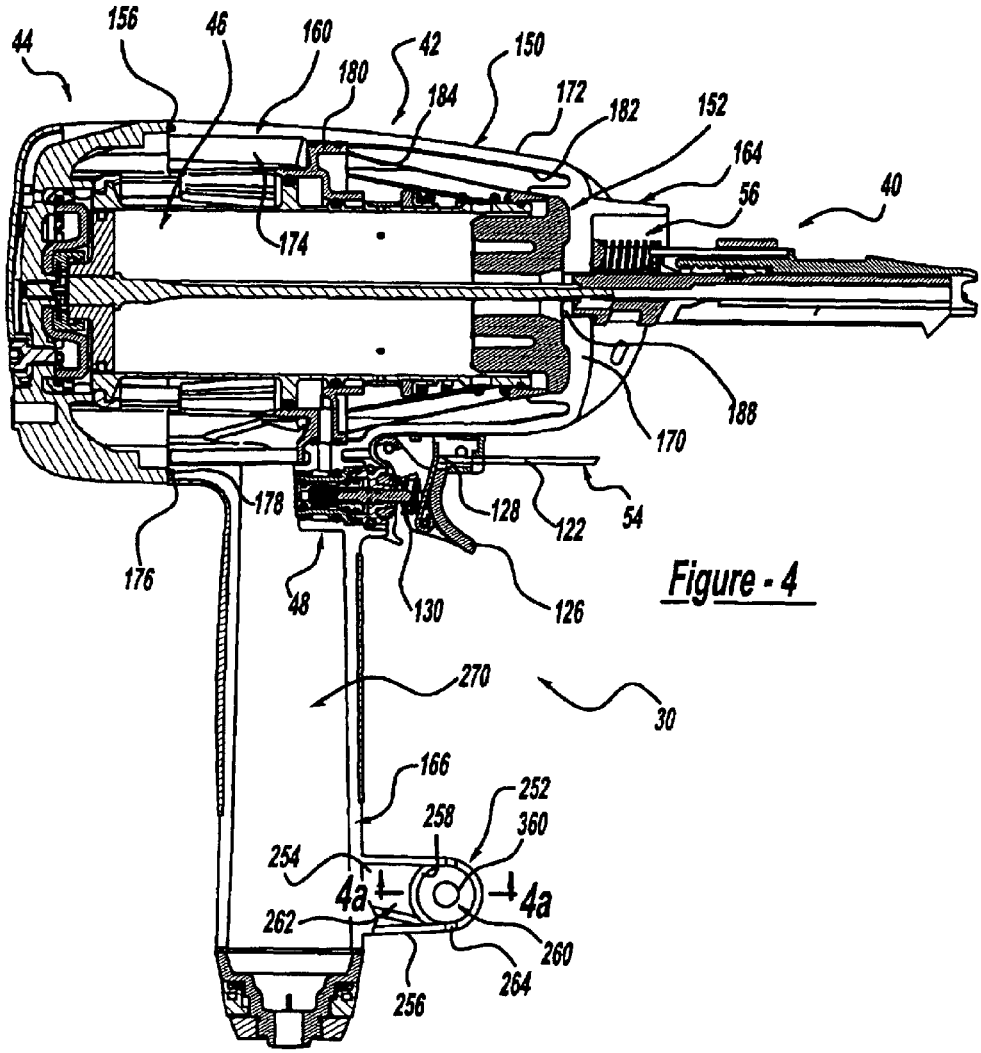
FIG. 4 is a sectional view of the tool of FIG. 1 taken through its longitudinal axis.
Figure 4A:
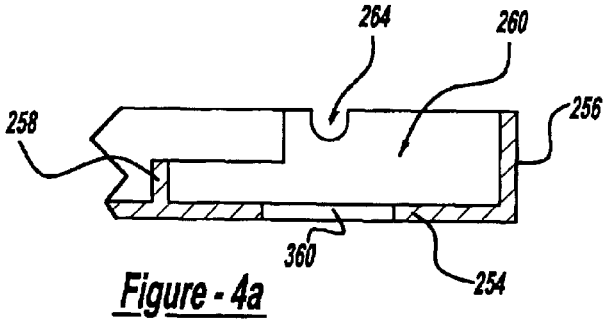
FIG. 4*a* is a section view taken along the line 4*a*—4*a* of FIG. 4.
Figure 5:
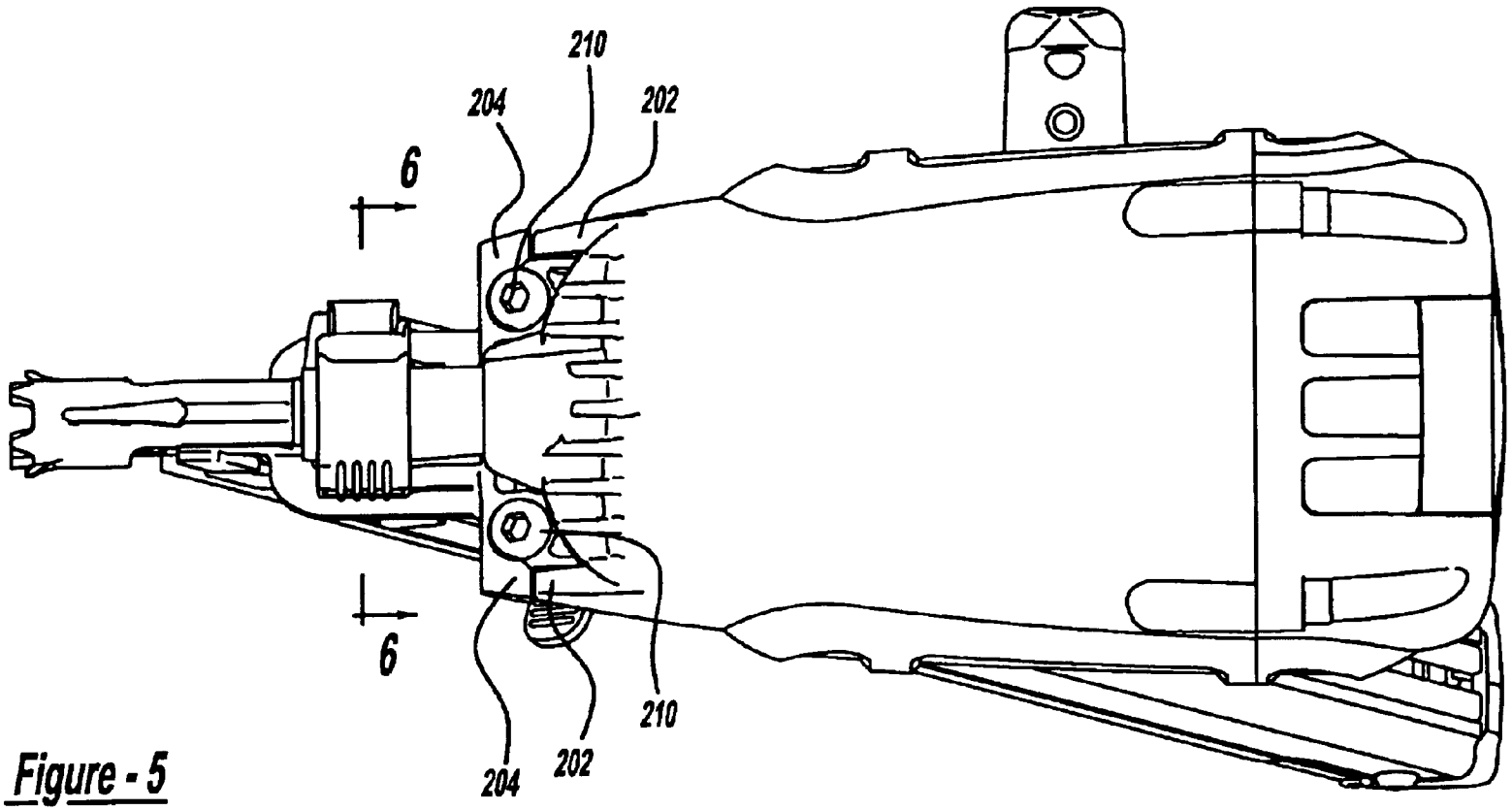
FIG. 5 is a top view of the tool of FIG. 1.
Figure 6:
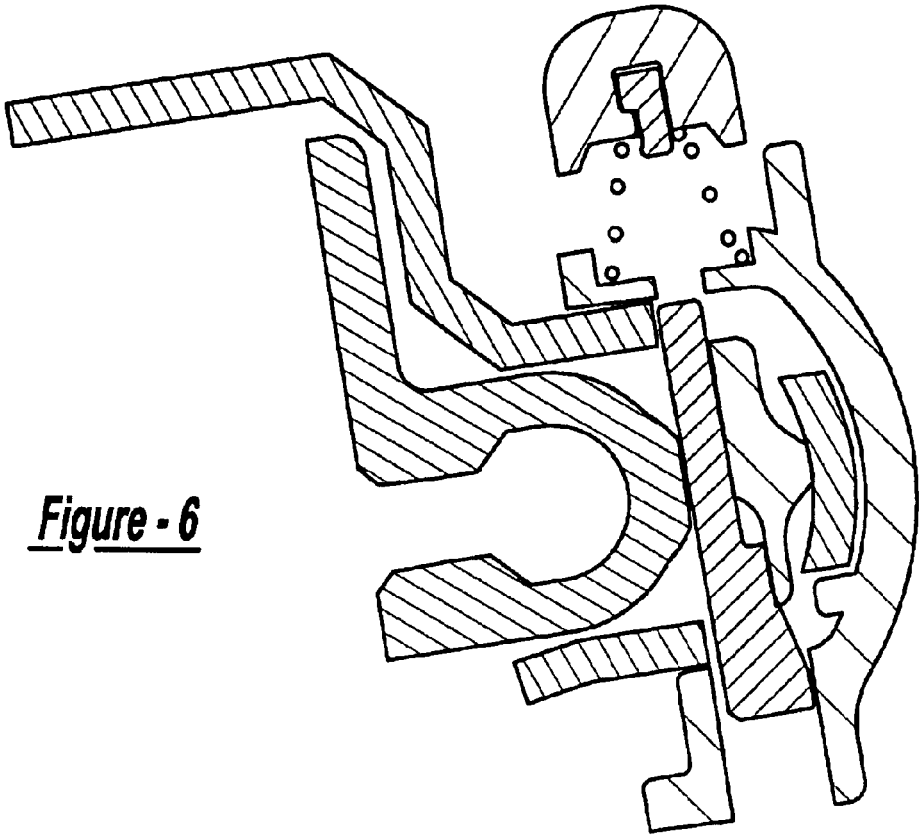
FIG. 6 is a sectional view taken along the line 6—6 of FIG. 5.

The handle portion 166 is preferably non-circular in shape and contoured to comfortably fit the hand of a tool operator. The distal end 250 of the handle portion 166 is enlarged so as to render the handle portion 166 less prone to slipping out of the tool operator's hand. With additional reference to FIG. 4*a*, a clamp boss 252 is coupled to the forward face of the distal end 250 of the handle portion 166. The clamp boss 252 includes a clamp boss base 254 that extends toward the front of the tool 10, a clamp boss sidewall 256 that wraps around the perimeter of the clamp boss base 254 and an annular intermediate clamp boss wall 258 that cooperates with a portion of the clamp boss sidewall 256 to form a circular spring cavity 260. The clamp boss base 254 and the clamp boss sidewall 256 cooperate to form a clamp cavity 262 into which the magazine clamp assembly 154 is disposed. A pair of U-shaped pin apertures 264, which will be discussed in further detail below, are formed into an end of the clamp boss sidewall 256.

The handle portion 166 intersects both the housing body 160 and the trigger housing 162 and includes an air inlet cavity 270 which extends through the distal end 250 of the handle portion 166 to receive a supply of compressed air. The air inlet cavity 270 extends through the handle portion 166 and into both the housing cavity 174 and the trigger housing 162 to permit the compressed air to be directed through the tool 10 in a predetermined manner that will be described in detail, below.

In the example provided, the magazine clamp assembly 154 is illustrated to include a clamp pin 300, a compression spring 302, a spring collar 304, an actuating cam 306 and a coupling pin 308. The clamp pin 300 includes a head portion 322, a first body section 324, which is coupled to the head portion 322, and a second body section 326 that is coupled to the opposite end of the first body section 324. The first body section 324 is generally cylindrically shaped and includes a pair of parallel flats 328. The second body section 326 is generally cylindrically shaped but has an outer diameter that is smaller than that of the first body section 324. The head portion 322 includes a frusto-conical abutting face 330.

The spring collar 304 includes a first annular portion 340 having a diameter that is sized to fit within the compression spring 302, and a second annular portion 342 that is relatively larger in diameter than the compression spring 302 and which has a flat contact surface 344. A pin aperture 346 is formed through the spring collar 304 that is sized to receive the second body section 326 of the clamp pin 300.

The actuating cam 306 has a base portion 350 and a leg portion 352 which are arranged relative to one another in an L-shape. The end of the base portion 350 opposite the intersection point 354 between the base and leg portions 350 and 352 includes a coupling pin aperture (not specifically shown) which is sized to engage the coupling pin 308. The leg portion 352 of the actuating cam 306 is arcuate in shape and includes a plurality of gripping protrusions 356 or is otherwise textured on its inside surface so as to improve the tool operator's ability to move the actuating cam 306 in a desired direction. A slot 358, which is sized to engage the second body segment 326 of the clamp pin 300 in a slip-fit manner, is formed into the actuating cam 306 through the base portion 350 and a portion of the leg portion 352.

The clamp pin 300 extends through a pin aperture 360 formed into the clamp boss base 254 of the clamp boss 252 such that the second body section 326 extends into the spring cavity 260. The compression spring 302 is positioned over the second body section 326 and into the spring cavity 260. The spring collar 304 is placed over the second body section 326 such that the first annular portion 340 is disposed inside the compression spring 302. The base portion 350 of the actuating cam 306 is positioned into contact with the flat contact surface 344 such that the second body segment 326 extends into the portion of the slot 358 that is formed into the base portion 350 of the actuating cam 306. The coupling pin 308, which is a roll-pin in the example illustrated, is positioned into one of the U-shaped pin apertures 264 and driven through the base portion 350 of the actuating cam 306 and into engagement with a pin aperture 364 in the second body segment 326 of the clamp pin 300. Accordingly, the coupling pin 308 pivotably couples the actuating cam 306 to the clamp pin 300. Rotation of the actuating cam 306 about the coupling pin 308 places the intersection point 354 into contact with the flat contact surface 344, causing the spring collar 304 to compress the compression spring 302 and transmit a clamping force to the head portion 322 of the clamp pin 300. When the actuating cam 306 has been pivoted sufficiently so as to place the leg portion 352 into contact with the flat contact surface 344, the force exerted by the compression spring 302 urges the spring collar 304 against the leg portion 352 to releasably lock the actuating cam 306 in place. The clamp cavity 262 protects the actuating cam 306 from being contacted during the operation of the tool 10, thereby guarding against the inadvertent unlocking or releasing of the actuating cam 306.

Figure 10:
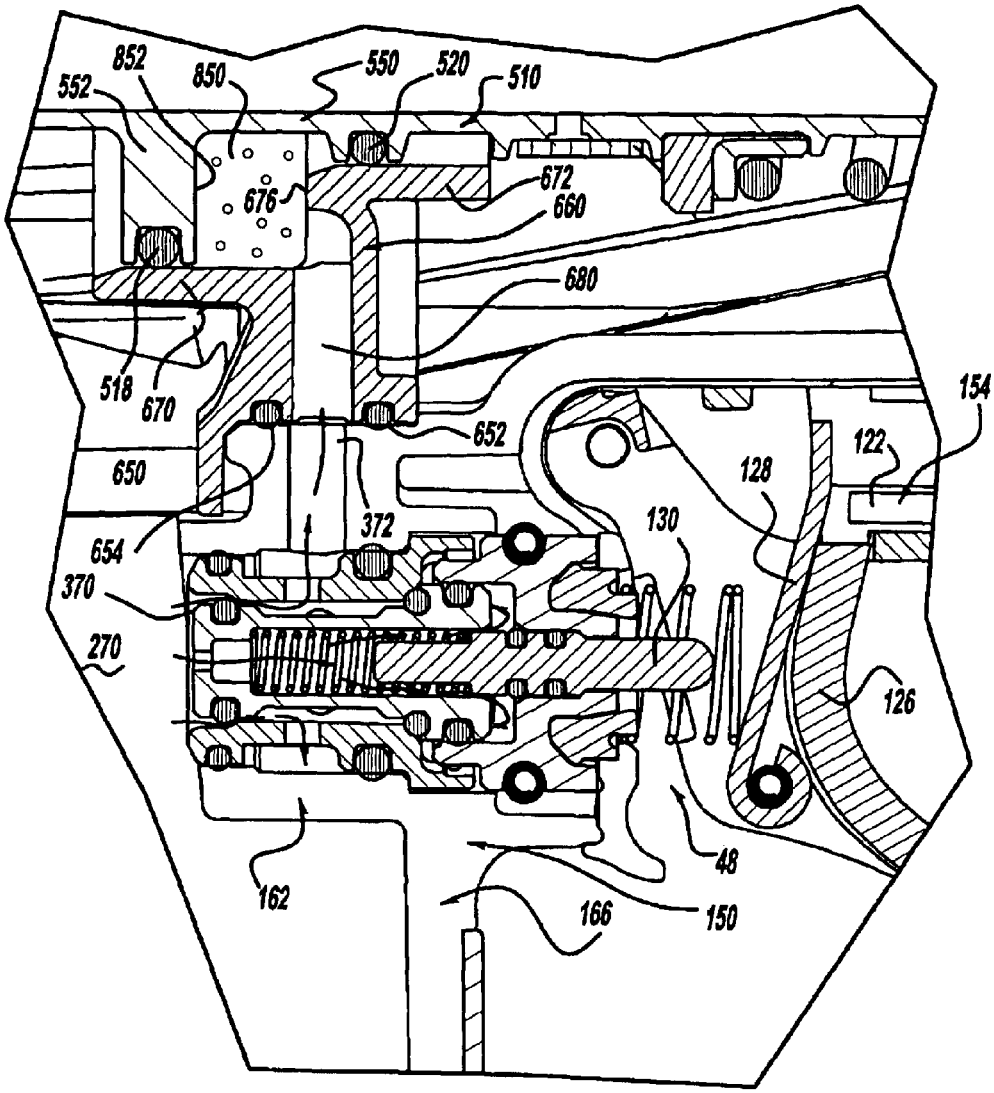
FIG. 10 is an enlarged portion of FIG. 4 illustrating the trigger assembly in greater detail.

In FIG. 10, the trigger housing 162 is configured to receive the trigger assembly 48 and includes a supply port 370, which is coupled to the air inlet cavity 270 to provide the trigger assembly 48 with a source of compressed air. A biasing port 372 extends from the trigger housing 162 through the guide bore 180 in the housing cavity 174 that permits the trigger assembly 48 to direct air to or exhaust air from the housing cavity 174.

Figure 7:
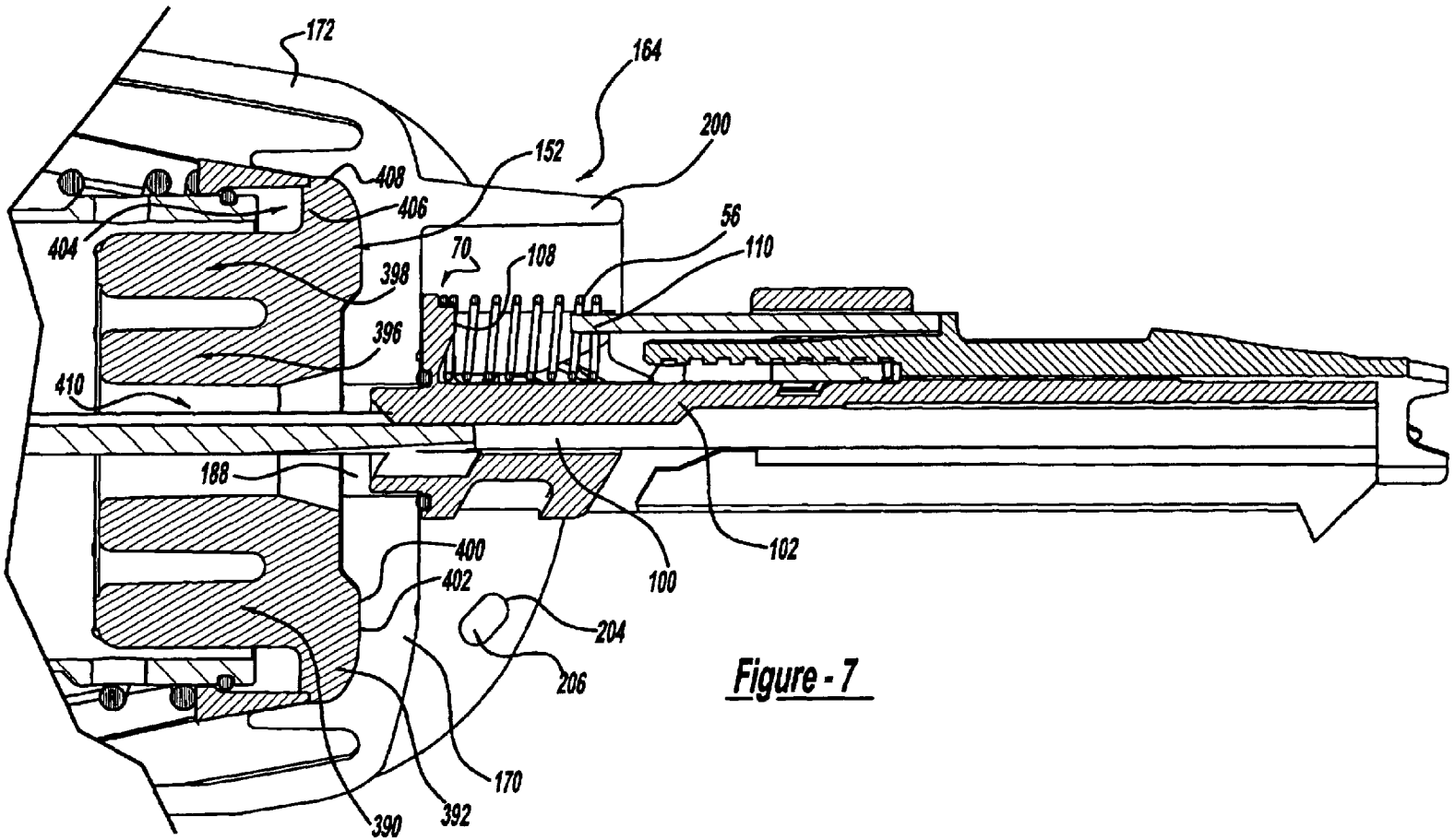
FIG. 7 is an enlarged portion of FIG. 4 illustrating the nose assembly in greater detail.
Figure 8:
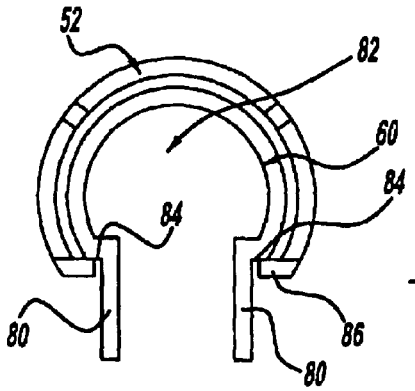
FIG. 8 is a front view of a portion of the tool of FIG. 1 illustrating the nose body and the contact tip in greater detail.
Figure 11:
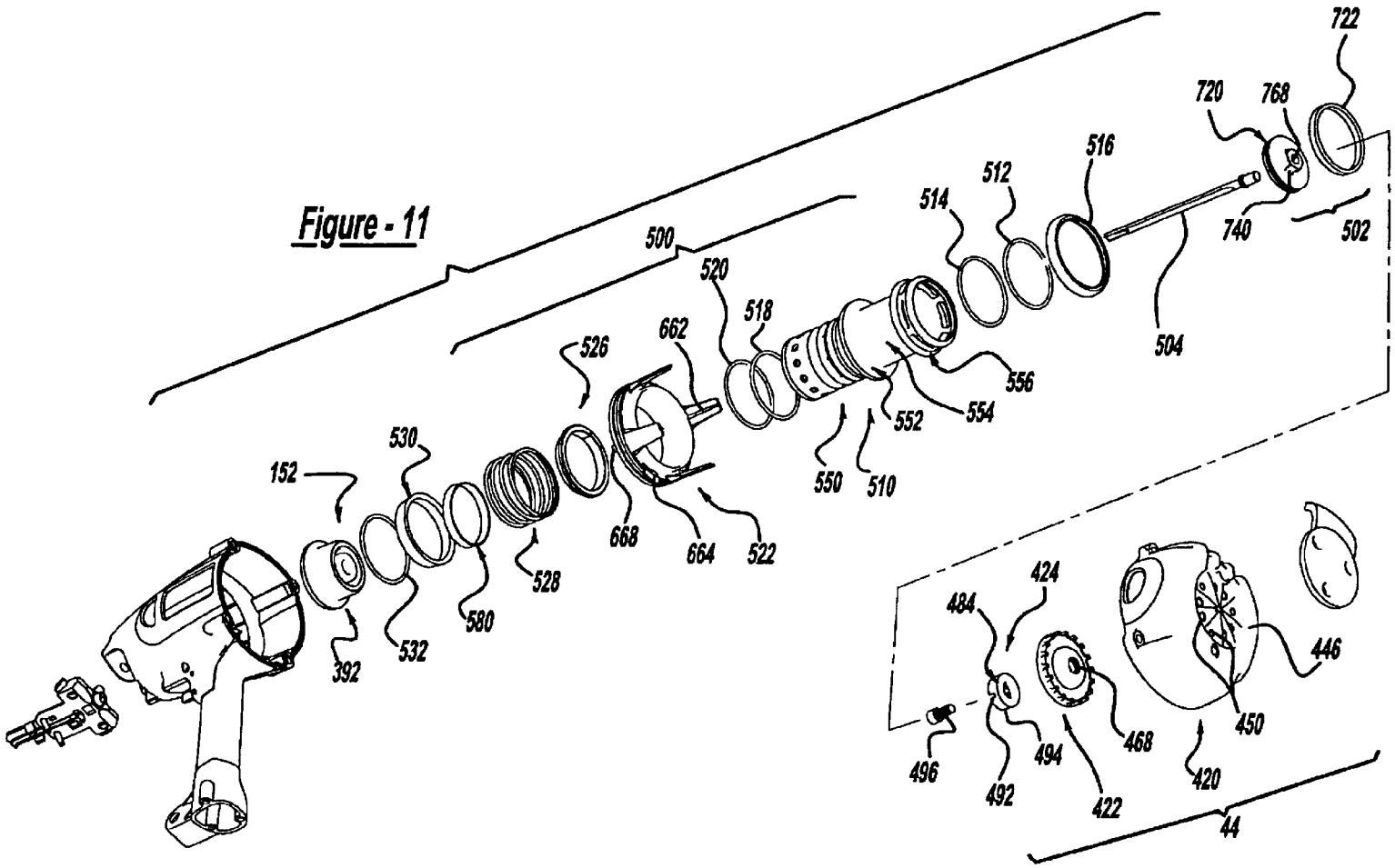
FIG. 11 is an exploded view of the tool of FIG. 1.

As shown in FIGS. 7 and 11, the piston bumper 152 is a unitarily formed molded elastomeric structure. In the particular example illustrated, the piston bumper 152 has a cylindrical body portion 390 and an annular lip 392. The cylindrical body portion 390 preferably includes a first annular bumper portion 396 and a second annular bumper portion 398 that is generally larger in diameter than the first annular bumper portion 396 and which is disposed between the first annular bumper portion 396 and the annular lip 392. The annular lip 392 extends radially outwardly of the body portion 390 and includes a front abutting face 400 that is configured to abut the inside surface 402 of the housing body 160 and sealingly engage the front base 170 of the housing body 160. The annular lip 392 also includes a rear abutting face 404 having a first annular lip portion 406 and a second annular lip portion 408 that that lies radially outwardly of and recessed forwardly relative to the first annular lip portion 406. The rear abutting face 404 and a cylindrically-shaped driver blade aperture 410 that extends through the center of the piston bumper 152 will be described in detail, below.

Cap Assembly

Figure 12:
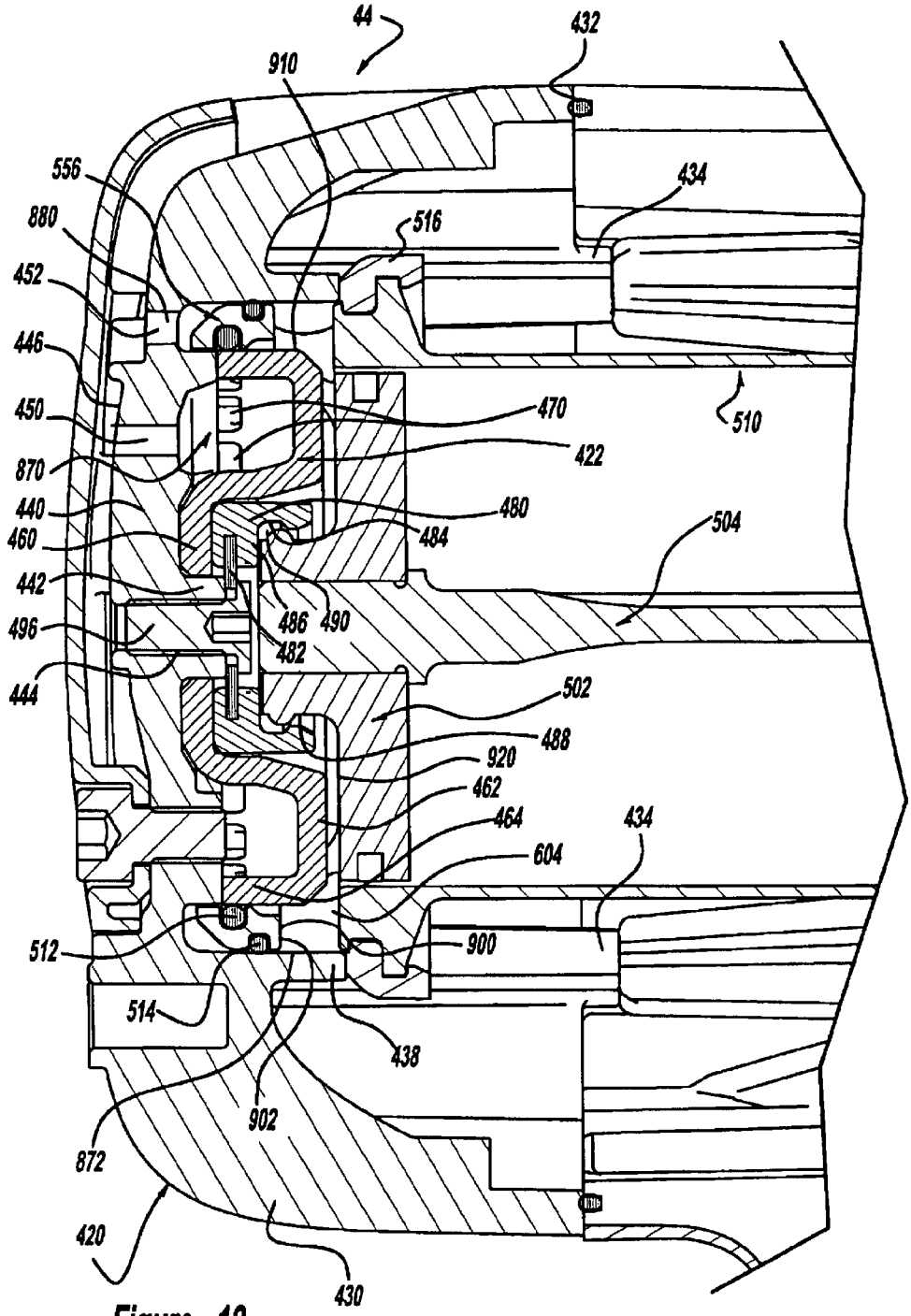
FIG. 12 is an enlarged portion of FIG. 4 illustrating the rear of tool in greater detail.

With reference to FIGS. 11 and 12, the cap assembly 44 includes a cap housing 420, an exhaust manifold 422 and a top bumper 424. The cap housing 420 includes an outer cap wall 430 that is generally flat at the rear of the tool 10, but folds over on its sides to form a cup-like container having a generally flat forward face 432 that is configured to engage the housing seal 156 to permit the cap housing 420 to be sealingly coupled to the rear of the housing 150.

The cap housing 420 also includes a plurality of foot tabs 434, a plurality of strengthening gussets (not specifically shown), an annular exhaust port wall 438, an exhaust button 440 and a cylindrical locating hub 442 having a threaded aperture 444 formed therethrough. The foot tabs 434 extend forwardly from the flat portion of the outer cap wall 430 beyond the front face 432 by a predetermined distance. The outside diameter of the foot tabs 434 is sized such that the foot tabs 434 fit within the housing cavity 174. The foot tabs 434 will be discussed in greater detail, below, The strengthening gussets are employed to couple both the foot tabs 434 or the outer cap wall 430 to the annular exhaust port wall 438, which extends forwardly from the flat rear portion 446 of the outer cap wall 430. The exhaust button 440 is an annular member that also extends forwardly from the flat rear portion 446 of the outer cap wall 430 but which is spaced apart from the annular exhaust port wall 438 and the locating hub 442. A plurality of primary exhaust ports 450 are formed through the exhaust button 440 and a plurality of secondary exhaust ports 452 are formed through the portion of the outer cap wall 430 between the annular exhaust port wall 438 and the exhaust button 440.

Figure 13:
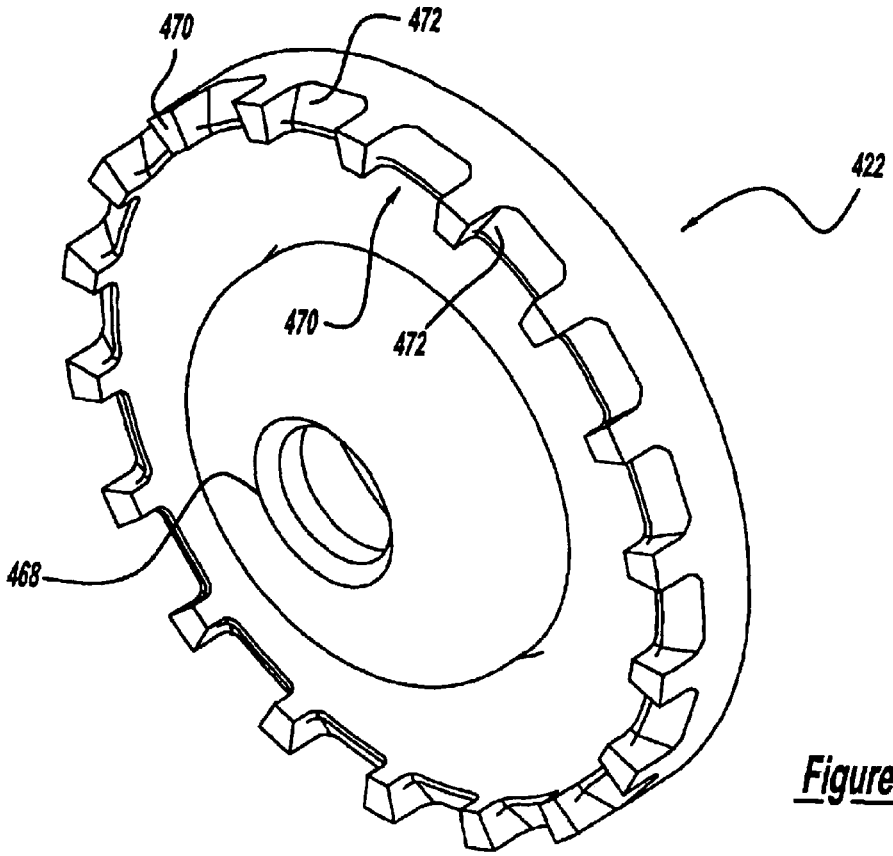
FIG. 13 is a sectional view of a portion of the exhaust manifold illustrating the construction of the exhaust ports in greater detail.

The exhaust manifold 422 is preferably unitarily formed from a molded from a plastic material and includes a center hub 460, an annular spacing wall 462 and an annular manifold wall 464. The center hub 460 is configured to fit between the exhaust button 440 and the locating hub 442 and includes a hub aperture 468 that is configured to engage the locating hub 442 in a slip fit manner. The annular spacing wall 462 is coupled to the forward-most portion of the center hub 460 and is spaced apart from the exhaust button 440. The annular manifold wall 464 is coupled to the outer perimeter of the annular spacing wall 462 and includes a plurality of circumferentially extending exhaust slots 470 that are spaced around the circumference of the annular manifold wall 464. The exhaust slots 470 are generally U-shaped and as best shown in FIG. 13, have a rear edge 472 that tapers rearwardly and inwardly toward the center hub 460.

Returning to FIGS. 11 and 12, the top bumper 424 preferably includes a dampening member 480 that is molded from an elastomeric material, such as urethane, and a structural member 482, such as a washer, that is molded into the dampening member 480. The dampening member 480 is a cup-shaped structure that is sized to fit within the center hub 460 of the exhaust manifold 422. The dampening member 480 includes an annular wall 484 that extends forwardly from the base 486 of the dampening member 480. A ridge 488 is formed into the forward end of the annular wall 484, thereby creating a groove 490 between the base 486 of the dampening member 480 and the ridge 488. A plurality of slits 492 are formed into the annular wall 484, creating a plurality of wall segments 494 that are flexibly coupled to the base 486. A threaded fastener 496 is threadably engaged to the threaded aperture 444 in the locating hub 442 to fixedly but removably couple the top bumper 424 to the cap housing 420. The structural member 482 is employed so as to permit the clamping force that is exerted by the threaded fastener 496 to be transmitted through the top bumper 424 without crushing the base 486 of the dampening member 480. A portion of the clamping force is transmitted through the base 486 of the dampening member 480 and into the center hub 460 of the exhaust manifold 422 to maintain the exhaust manifold 422 in a stationary position relative to the cap housing 420.

Engine Assembly

Engine assembly 46 is shown to include a cylinder assembly 500, a piston assembly 502, a rod or driver blade 504. The cylinder assembly 500 includes a hollow, cylindrical, and unitarily constructed sleeve 510, an inner exhaust port seal 512, an outer exhaust port seal 514, a cap flange seal 516, rear and front guide seals 518 and 520, a guide assembly 522, a compensating valve 524, a rear spring flange 526, a spring 528, a front spring flange 530 and a front spring flange seal 532. In the particular embodiment illustrated, inner exhaust port seal 512, outer exhaust port seal 514, rear and front guide seals 518 and 520 and front spring flange seal 532 are conventional, commercially available O-ring seals. The cap flange seal 516 is a molded elastomeric seal having an outside surface with a generally flat seal face 540 and first and second radially inwardly extending flanges 542 and 544, respectively, that are spaced apart from one another to form an engagement groove 546 therebetween.

Figure 16:
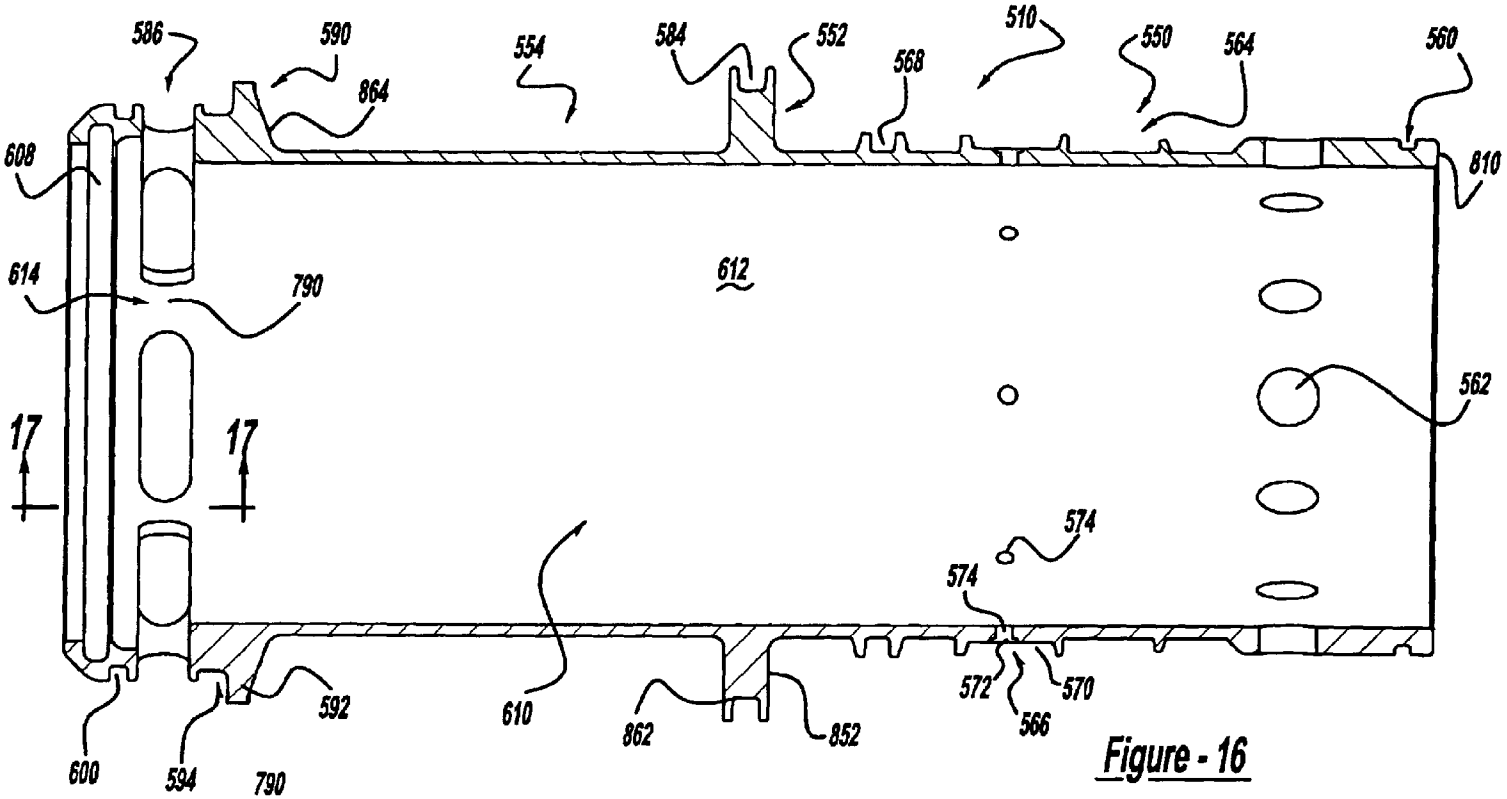
FIG. 16 is a sectional view of the sleeve taken along its longitudinal axis.

With additional reference to FIG. 16, the sleeve 510 is shown to include a first sleeve body portion 550, an annular sleeve flange 552, a second sleeve body portion 554 having a maximum outer diameter that is generally the same as that of the first sleeve body portion 550 and a third sleeve body portion 556 having a maximum outer diameter that is generally larger than that of the first sleeve body portion 550. The first sleeve body portion 550 includes a first U-shaped seal groove 560, which is sized to receive the front spring flange seal 532, a plurality of circumferentially-spaced front exhausting ports 562, a spring flange groove 564, which is sized to receive the rear spring flange 526, a valve groove 566, which is discussed in greater detail, below, and a second U-shaped seal groove 568, which is sized to receive the front guide seal 520.

The valve groove 566 has a first U-shaped portion 570, a second U-shaped portion 572 and a plurality of valve apertures 574. The first U-shaped portion 570 is sized to receive the compensating valve 524, which in the particular embodiment illustrated, is a flat elastomeric band 580. The second U-shaped portion 572 is disposed within the first U-shaped portion 570, but has a diameter that is somewhat smaller than that of the first U-shaped portion 570 so as to define an annular ring that extends around the circumference of the first U-shaped portion 570. In the particular embodiment illustrated, the diameter of the second U-shaped portion 572 is about 0.010 inches to about 0.030 inches smaller in diameter than the first U-shaped portion 570. The valve apertures 574 are illustrated to be relatively small diameter holes that are located within the second U-shaped portion 572 and which are drilled through the sleeve 510. The valve apertures 574 will be discussed in greater detail, below, as will the set of front exhausting ports 562 that are located between the first U-shaped seal groove 560 and the spring flange groove 564.

The annular sleeve flange 552 extends radially outwardly from the first sleeve body portion 550 of the sleeve 510 and separates the first and second sleeve body portions 550 and 554 from one another. A third U-shaped seal groove 584, which is sized to receive the rear guide seal 518 is formed into the outer surface of the annular sleeve flange 552.

The majority of the second sleeve body portion 554 of the sleeve 510 is of approximately the same outer diameter as the first sleeve body portion 550. The rear end of the second sleeve body portion 554, however, includes a flange portion 590 that extends radially outwardly to form a seal lip 592 and a fourth U-shaped seal groove 594 prior to its connection with the third sleeve body portion 556. The seal lip 592 is configured to engage the engagement groove 546 formed into the cap flange seal 516 and abut the first and second radially inwardly extending flanges 542 and 544. The fourth U-shaped seal groove 594 is configured to receive a portion of the first radially inwardly extending flange 542.

The third sleeve body portion 556 is fixedly coupled to the end of the second sleeve body portion 554 and is larger in diameter than the outer diameter of the first sleeve body portion 550. A fifth U-shaped seal groove 600 is formed into the outer surface of the third sleeve body portion 556 and is sized to receive the outer exhaust port seal 514. A plurality of circumferentially extending rear exhaust slots 604 are disposed around the perimeter of the third sleeve body portion 556. The rear exhaust slots 604 are located between the fourth and fifth U-shaped seal grooves 594 and 600. A sixth U-shaped seal groove 608, which is configured to receive the inner exhaust port seal 512, is formed into the inner diameter of the third sleeve body portion 556.

The hollow cavity 610 that is formed through the sleeve 510 has a first cavity portion 612 that is generally of a constant diameter over the portion of its length that includes the first and second sleeve body portions 550 and 554 and the annular sleeve flange 552. The hollow cavity 610 also has a second cavity portion 614 having a larger diameter than that of the first cavity portion 612.

Figure 14:
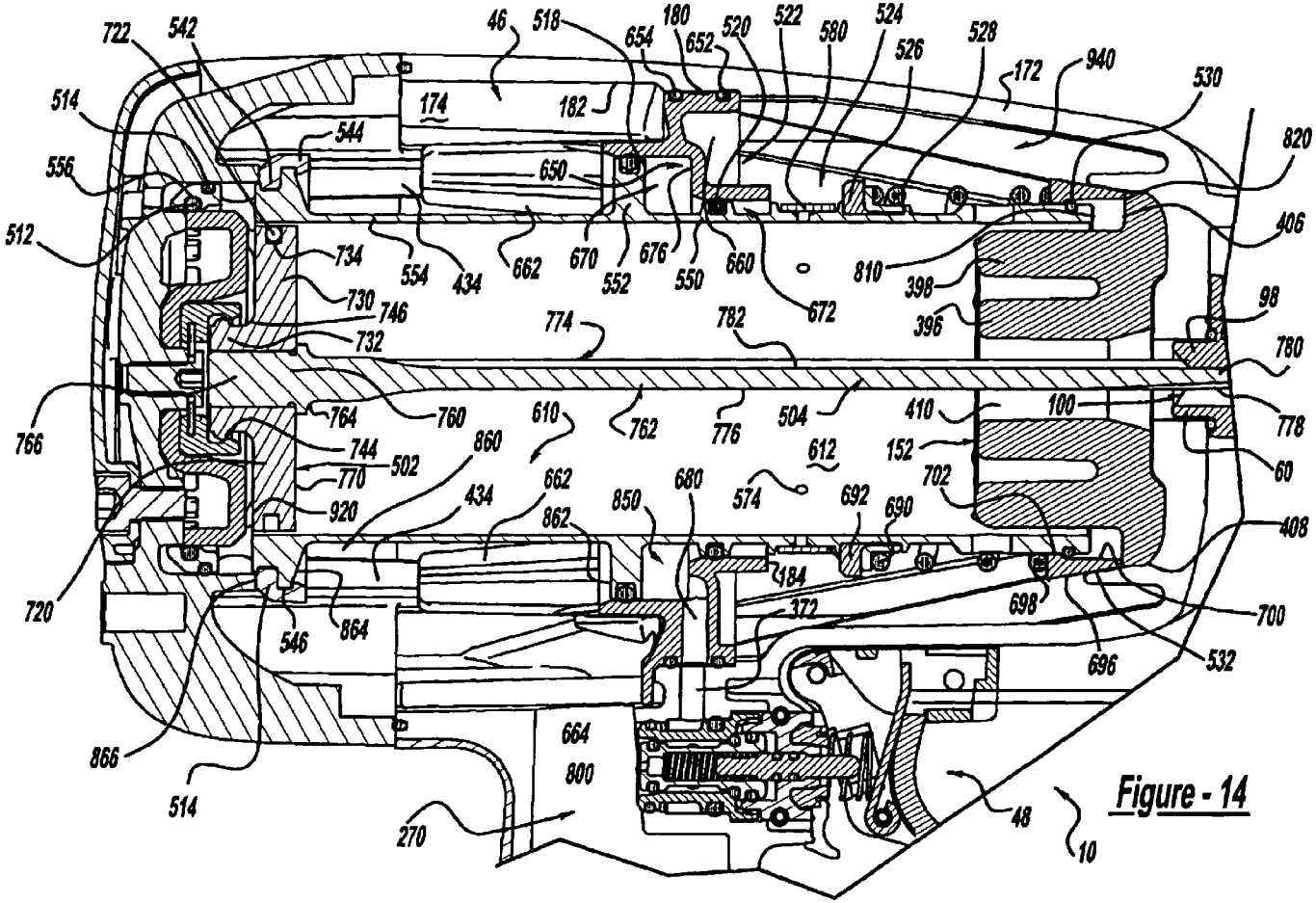
FIG. 14 is an enlarged portion of FIG. 4 illustrating the engine assembly in greater detail.
Figure 15:
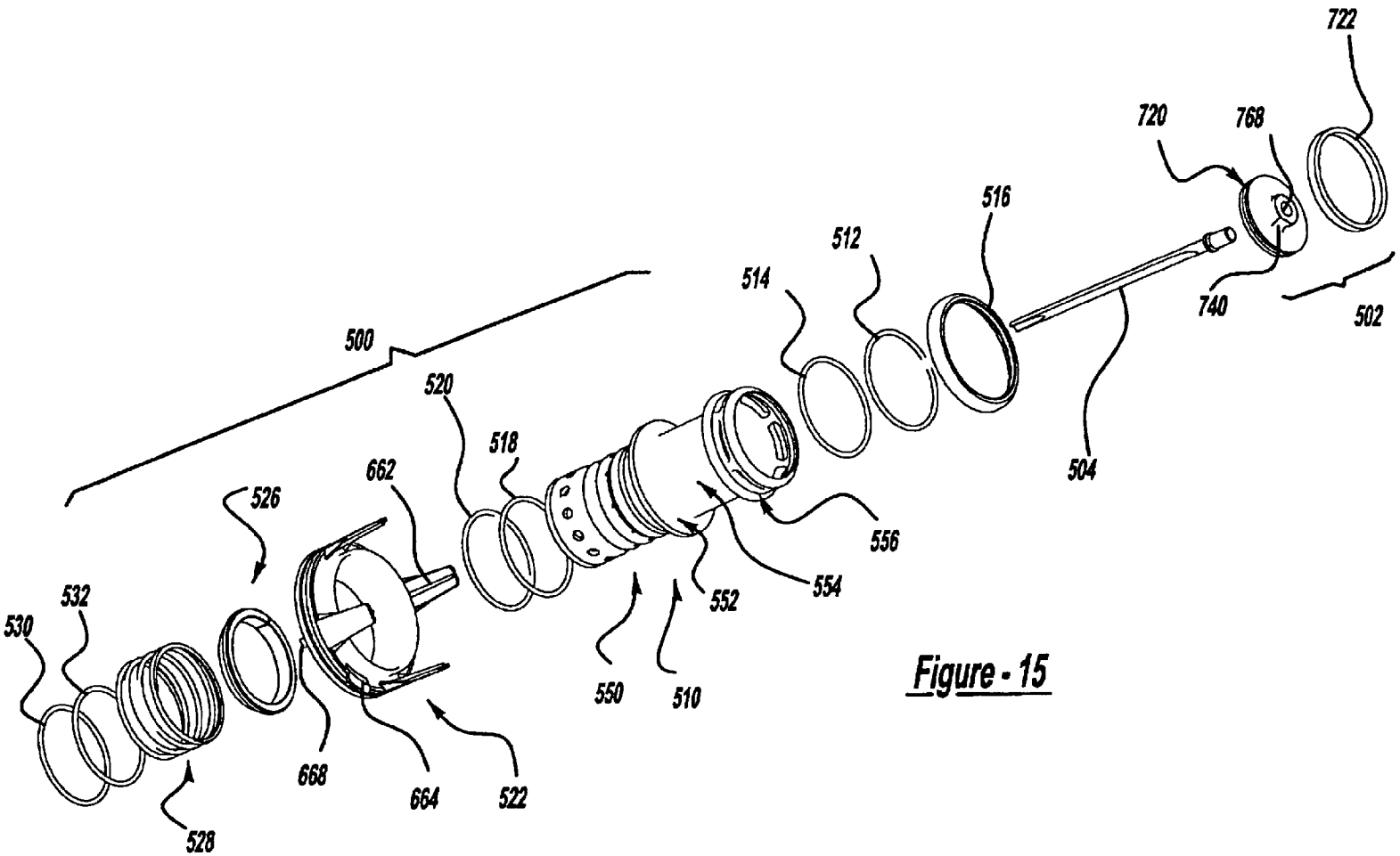
FIG. 15 is an enlarged portion of FIG. 11 illustrating the engine assembly in greater detail.

In FIG. 14, the guide assembly 522 is shown to include a guide 650 and first and second housing seals 652 and 654, which in the particular embodiment illustrated, are O-ring seals. The guide 650 is a molded plastic component, having a stepped-diameter body portion 660, a plurality of longitudinally extending legs 662, a locating tab 664 and a plurality of stop tabs 668. The stepped-diameter body portion 660 includes a flange bore 670, which is sized to receive the annular sleeve flange 552 and sealingly engage the rear guide seal 518, a body bore 672, which is sized to receive the first sleeve body portion 550 and sealingly engage the front guide seal 520, and an abutting flange 676 that forms the transition between the flange bore 670 and the body bore 672.

The longitudinally extending legs 662 extend away from the stepped-diameter body portion 660 and are spaced apart circumferentially in equal amounts. The locating tab 664 is positioned on the same side of the stepped-diameter body portion 660 as the longitudinally extending legs 662 between two of the longitudinally extending legs 662. The locating tab 664 is employed to signify the presence of an air gallery 680 and locate the guide assembly 522 relative to the housing assembly 42. The air gallery 680 is configured to permit air to flow through the stepped-diameter body portion 660 from a point between the first and second housing seals 652 and 654 through the stepped-diameter body portion 660 and out the abutting flange 676.

The rear and front guide seals 518 and 520 and the elastomeric band 580 that forms a portion of the compensating valve 524 are initially installed to the sleeve 510. Thereafter, the guide assembly 522 is positioned over the first sleeve body portion 550 and pushed onto the sleeve 510 such that the flange bore 670 and body bore 672 are sealingly engaged to the rear and front guide seals 518 and 520, respectively, and the abutting flange 676 abuts the annular sleeve flange 552.

The rear spring flange 526 is next installed to the sleeve 510. The rear spring flange 526 is a plastic collar that is split on one side to permit the ends of the rear spring flange 526 to be spread apart so that it may be loaded onto the first sleeve body portion 550 of the sleeve 510 and into the spring flange groove 564. The rear spring flange 526 has a cylindrically shaped body portion 690 and a flange portion 692 that extends radially-outwardly from the body portion 590 in a manner that provides the rear spring flange 526 with a L-shaped cross-section. The rear spring flange 526 is located to the spring flange groove 564 such that the flange portion 692 is nearest the annular sleeve flange 552.

The front spring flange 530 is a plastic collar having a tapering outside diameter 596 and a generally flat rear face 698. The inside surface 700 of the front spring flange 530 is generally cylindrical, but includes an annular protrusion 702 that extends radially inwardly of the remainder of the inside surface 700 and which engages the first sleeve body portion 550 of the sleeve 510 in a slip-fit manner.

The spring 528 is a conventional compression spring having both ends ground flat. The spring 528 is disposed over the first sleeve body portion 550 of the sleeve 510 such that its rear end abuts the flange portion 692 of the rear spring flange 526. Thereafter, the front spring flange 530 is positioned such that its rear face 698 contacts the second end of the spring 528. The front spring flange 530 is pushed toward the annular sleeve flange 552 to compress the spring 528 a sufficient distance to permit the front spring flange seal 532 to be inserted into the first U-shaped seal groove 560. Thereafter, the front spring flange 530 is moved toward the front of the sleeve 510 such that the front spring flange seal 532 is sealingly engaged with the inside surface 700 of the front spring flange 530. The rear side of the front spring flange seal 532 contacts the annular protrusion 702 to limit the forward travel of the front spring flange 530 prior to the installation of the engine assembly 46 to the housing assembly 42. Forward motion of the guide assembly 522 along the sleeve 510 is checked by contact between the stop tabs 668 and the rear surface of the flange portion 692 of the rear spring flange 526 to thereby prevent the guide 650 from becoming disengaged from the rear and front guide seals 518 and 520. Construction in this manner is highly advantageous in that it permits the entire cylinder assembly 500 to be pre-assembled outside of the housing assembly 42 in a relatively easy and cost efficient manner.

The piston assembly 502 includes a piston 720 and a ring 722. In the example provided, the piston 720 is shown to include a first piston portion 730 and a second piston portion 732. The first piston portion 730 in an annular member that is smaller in diameter than the first cavity portion 612 of the hollow cavity 610 in the sleeve 510. A U-shaped annular ring groove 734 is formed around the circumference of the first piston portion 730 that is sized to receive the ring 722.

In the embodiment illustrated, the ring 722 is shown to be fabricated from a plastic material and have a rectangular cross-section. The ring 722 is split to permit its ends of the ring 722 to be spread apart so that it may be loaded around the first piston portion 730 and into the ring groove 734. The second piston portion 732 is an annular member that is smaller in diameter than the first piston portion 730. The second piston portion 732 is coupled to the rear end of the first piston portion 730 and includes a pair of wrench flats 740 and a locking protrusion 744, both of which will be discussed in more detail, below. A generous fillet radius 746 is employed at the intersection between the first and second piston portions 730 and 732 so as to reduce the concentration of stress within the piston 720.

The construction of the driver blade 504 is largely conventional and as such, a detailed discussion of it is neither required nor within the scope of this disclosure. Briefly, the driver blade 504 is shown to include a coupling portion 760 and a driver body 762. In the example provided, the coupling portion 760 includes a collar 764 and a threaded portion 766 which are formed into the rear end of the driver blade 504. The wrench flats 740 on the second piston portion 732 are employed to facilitate relative rotation between the driver blade 504 and the piston 720 to permit the threaded portion 766 to threadably engage a threaded aperture 768 that is formed through the piston 720 and to permit the collar 764 to engage the front surface 770 of the piston 720 to generate a clamping force that fixedly but removably couples the piston 720 and the driver blade 504 together. Coupling of the piston 720 and the driver blade 504 via a threaded connection is presently preferred so as to permit the servicing and replacement of the driver blade 504, since this portion of the tool 10 is essentially perishable. Those skilled in the art will understand from this disclosure, however, that other coupling mechanisms, such as press-fitting, shrink fitting, welding, or any other mechanical coupling method may also be employed.

The driver body 762 is sized to fit in the blade cavity 82 and is shown to include a keyway 774, a slide surface 776, a loading groove 778 and a tip portion 780. The keyway 774 is illustrated to be a cut that is formed into the surface of the driver body 762 along its longitudinal axis. The fastener stop 102 that is formed into the internal cavity 100 in the nose guide 98 is disposed within the keyway 782 to guard against a situation wherein fasteners F feed rearwardly into the tool 10. The slide surface 776 is generally flat and provides the driver body 762 with a relatively large surface that will consistently slide over the fasteners F that are loaded into the magazine assembly 20. The tip portion 780 is formed at the front end of the driver body 762 and is operable for contacting the fasteners F and driving them into a workpiece. The loading groove 778 is cylindrically shaped and is formed along an axis that is skewed to the longitudinal axis of the driver blade 504 such that it intersects both the tip portion 780 and the slide surface 776. The loading groove 778 is tapered such that it is deepest at the front of the driver blade 504. The loading groove 778 ensures that only one fastener F is sheared from the remaining fasteners F in the magazine assembly 20. The loading groove 778 also permits the fasteners F in the magazine assembly 20 to move upwardly toward the nose body 60 of the tool 10 prior to the time at which the driver blade 504 has stroked back to its rear-most (i.e., retracted) position to thereby minimize the lag time between the point at which the driver blade 504 has moved to its retracted position and the point at which the driver blade 504 can be moved forwardly to drive another fastener F.

Figure 17:
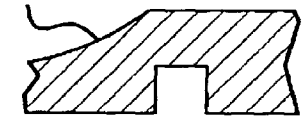
FIG. 17 is a sectional view taken along the line 17—17 of FIG. 16.

With additional reference to FIGS. 16 and 17, the driver blade 504 and the piston assembly 502, once coupled to one another, are inserted into the second cavity portion 614 of the hollow cavity 610 in the sleeve 510. The diameter of the second cavity portion 614 is larger than the diameter of the piston assembly 502 (with the ring 722 in an expanded condition). A chamfer 790 is employed at the front of the second cavity portion 614 to facilitate the transition to the smaller-diameter first cavity portion 612. With the exertion of light force onto the rear of the piston assembly 502, the piston assembly 502 is moved forwardly in the hollow cavity 610 and into contact with the chamfer 790. The chamfer 790 is operable for compressing the ring 722 to permit the piston assembly 502 to travel into the first cavity portion 612.

Once assembled, the engine assembly 46 is placed into the housing cavity 174 such that the locating tab 664 is aligned to a tab slot 800 formed into the housing cavity 174 and the driver blade 504 is inserted through the driver blade aperture 410 in the piston bumper 152 and into the internal cavity 100 in the nose guide 98. The engine assembly 46 is pushed forwardly into the housing cavity 174 to engage the guide assembly 522 against the guide stop 184. In this position, the first and second housing seals 652 and 654 sealingly engage the guide bore 180 that is formed into the inside surface 182 of the outwardly tapering sidewall 172. The first and second annular bumper portions 396 and 398 extend through the front face 810 of the sleeve 510 and into the hollow cavity 610. The front face 820 of the front spring flange 530 sealingly contacts the second annular lip portion 408 on the piston bumper 152. The cap assembly 44 is thereafter placed onto the rear end of the housing assembly 42 such that each of the longitudinally extending legs 662 contacts one of the foot tabs 434. The foot tabs 434 cooperate with the longitudinally extending legs 662 to prevent the guide assembly 522 from moving along the longitudinal axis of the tool 10. The sleeve 510, however, is slidable within the guide assembly 522, as will be discussed in greater detail, below.

Alternatively, the piston assembly 502 and driver blade 504 may be inserted into the housing cavity 174 such that the driver blade 504 is inserted through the driver blade aperture 410 in the piston bumper 152 and into the internal cavity 100 in the nose guide 98. The cylinder assembly 500 is then loaded into the housing cavity 174 in the manner discussed above. A lead L formed into the front face 810 of the sleeve 510 that permits the ring 722 to be compressed so that the piston assembly 502 can travel rearwardly into the first cavity portion 612 of the hollow cavity 610 in the sleeve 510.

Engine Operation

With reference to FIGS. 10, 14 and 16, when the tool 10 has been coupled to a source of compressed air, the trigger assembly 48 maintains the trigger valve 130 in an unactuated state wherein compressed air is directed from the supply port 370 to the biasing port 372 where it enters the air gallery 680 at a point between the first and second housing seals 652 and 654. Compressed air flows through the stepped-diameter body portion 660 and exits from the abutting flange 676 where it enters a sleeve return chamber 850 that is defined by the forward face 852 of the annular sleeve flange 552, the rear guide seal 518, the flange bore 670, the body bore 672, the front guide seal 520 and the first sleeve body portion 550 of the sleeve 510. As the guide 650 is not movable within the housing 150, the pressure of the air that is in the sleeve return chamber 850 is exerted against the front face 852 of the annular sleeve flange 552 to bias the sleeve 510 in a rearward direction.

The air inlet cavity 270 also provides compressed air to a sleeve extend chamber 860 that is defined by the rearward face 862 of the annular sleeve flange 552, the rear guide seal 518, the guide 650, the second housing seal 654, the portion of the outwardly tapering sidewall 172 that is situated rearwardly of the second housing seal 654, the outer portion of the cap housing 420 that includes the annular exhaust port wall 438, the cap flange seal 516 and the second sleeve body portion 554 of the sleeve 510. Compressed air in the sleeve extend chamber 860 directs force to both the rearward face 862 of the annular sleeve flange 552 and the front face 864 of the flange portion 590 of the second sleeve body portion 554 of the sleeve 510.

The forces that act on the annular sleeve flange 552 and the front face 864 of the flange portion 590, in cooperation with the force that is exerted by the spring 528, bias the sleeve 510 in a rearward direction into its retracted position such that the flat seal face 540 of the cap flange seal 516 sealingly engages the front face 866 of the annular exhaust port wall 438.

With reference to FIGS. 10 and 12, when the sleeve 510 is in the retracted position, a primary exhaust chamber 870 is defined by the cap flange seal 516, the inside surface 872 of the annular exhaust port wall 438, the outer exhaust port seal 514, the third sleeve body portion 556 of the sleeve 510, the inner exhaust port seal 512, the exhaust manifold 422, the second sleeve body portion 554 of the sleeve 510, the piston assembly 502 and the driver blade 504. The position of the sleeve 510 relative to the cap assembly 44 is such that the air that is in the primary exhaust chamber 870 is permitted to flow between the third sleeve body portion 556 and exhaust manifold 422, through the exhaust slots 470 in the exhaust manifold 422 and out the primary exhaust ports 450 in the exhaust button 440 where this air is vented to atmosphere.

With the sleeve 510 in the retracted position, a secondary exhaust chamber 880 is formed by the annular exhaust port wall 438, the outer exhaust port seal 514, the third sleeve body portion 556 of the sleeve 510, the inner exhaust port seal 512, the exhaust manifold 422, the exhaust button 440 and the portion of the outer cap wall 430 between the annular exhaust port wall 438 and the exhaust button 440. Air that is in the secondary exhaust chamber 880 is vented to the atmosphere through the primary exhaust ports 450 in the exhaust button 440 and through the secondary exhaust ports 452 in the portion of the outer cap wall 430 between the annular exhaust port wall 438 and the exhaust button 440.

Figure 18:
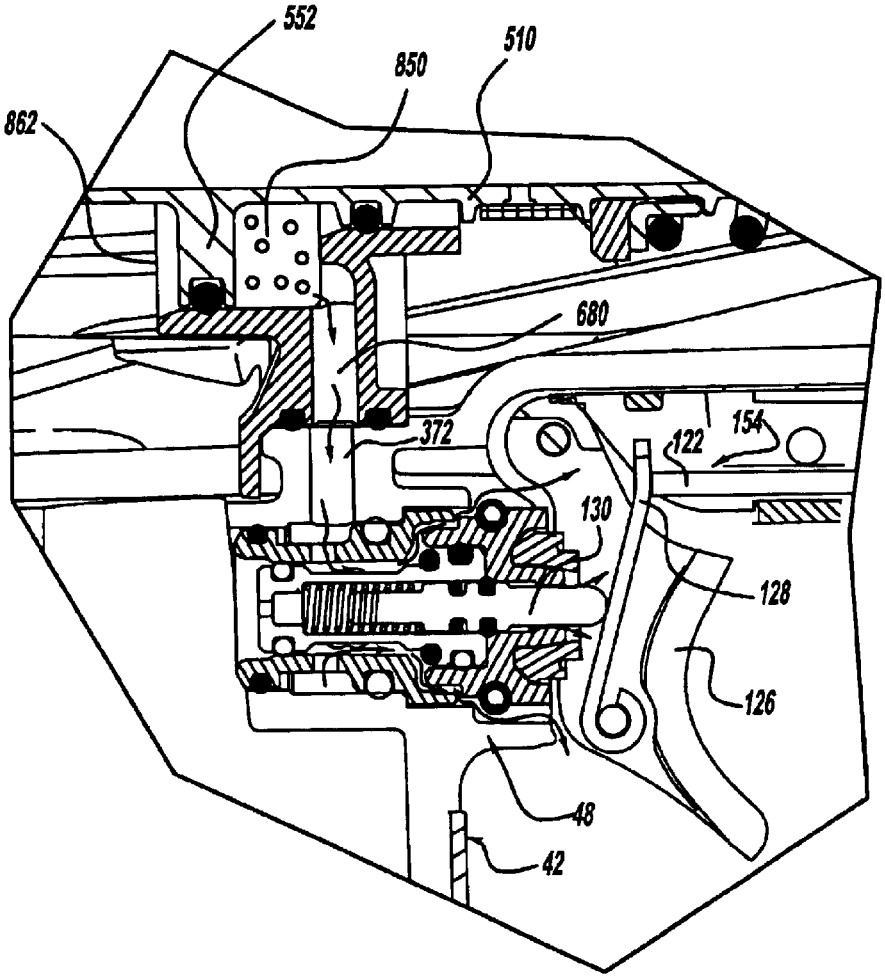
FIG. 18 is a sectional view similar to that of FIG. 10 but illustrating the trigger assembly in an actuated condition.

With reference to FIGS. 12, 14 and 18, when the trigger assembly 48 is actuated to change the state of the trigger valve 130 to an actuated state, air in the sleeve return chamber 850 is vented through the trigger assembly 48 to the atmosphere. Consequently, the force that is exerted onto the rear face 862 of the annular sleeve flange 552 causes the sleeve 510 to slide forwardly relative to the housing assembly 42. When the sleeve 510 slides in a forward direction, the seal between the cap flange seal 516 and the front face 866 of the annular exhaust port wall 438 is broken, permitting compressed air to flow through the rear exhaust slots 604 in the third sleeve body portion 556 of the sleeve 510. As the area of the front surface 900 of the rear exhaust slots 604 is larger than the area of its rear surface 902, the pressure of the air flowing through the rear exhaust slots 604 also tends to push the sleeve 510 in a forward direction. The piston bumper 152 checks forward travel of the sleeve 510. More specifically, forward travel of the sleeve 510 is checked when the front face 810 of the sleeve 510 contacts the first annular lip portion 406 of the piston bumper 152.

Simultaneous with the forward motion of the sleeve 510, the inner exhaust port seal 512 slides forwardly by an equal amount to sealingly engage the outer circumference 910 of the exhaust manifold 422 at a point forward of the exhaust slots 470 to thereby prevent air from flowing to the atmosphere through the exhaust slots 470. Pressure acts on the rear surface 920 of the piston assembly 502 to disengage the locking protrusion 744 in the second piston portion 732 from the groove 490 in the top bumper 424. The pressure acts on the piston assembly 502 to drive the piston assembly 502 and the driver blade 504 forwardly through the first cavity portion 612 of the hollow cavity 610 in the sleeve 510. Air in the first cavity portion 612 is compressed by the forward motion of the piston assembly 502, causing it to be expelled from the hollow cavity 610 through the internal cavity 100 in the nose guide 98, as well as through the front exhausting ports 562 and into a frontal air chamber 940. The frontal air chamber 940 is defined by the first sleeve body portion 550 of the sleeve 510, the front guide seal 520, the guide 650, the first housing seal 652, the outwardly tapering wall 172 of the housing body 160, the second annular lip portion 408 of the annular lip 392 in the piston bumper 152, the front spring flange 530 and the front spring flange seal 532.

The piston bumper 152 checks the forward motion of the sleeve 510. Thereafter, the piston assembly 502 pushes the driver blade 504 forwardly so that the tip portion 780 drives a fastener F into a workpiece (not shown). With the piston bumper 152 also checks the forward motion of the piston assembly 502 and effectively seals against the front surface 770 of the piston assembly 502 to seal the frontal air chamber 940. In this condition, the piston assembly 502 is positioned forwardly of the valve apertures 574 in the first sleeve body portion 550 of the sleeve 510. Accordingly, if the pressure of the air in the portion of the hollow cavity 610 that is rearward of the piston assembly 502 is greater than the pressure of the air in the frontal air chamber 940, the compensating valve 524 permits air to flow through the sleeve 510 and into the frontal air chamber 940 so as to balance the air pressure that is acting on the front and rear surfaces 770 and 920 of the piston assembly 502. The compensating valve 524, however, is a one-way valve that does not permit air to flow from the frontal air chamber 940 through the valve apertures 574 and into the hollow cavity 610.

Referring back to FIGS. 10, 12, 14 and 16, when the state of the trigger valve 130 is changed to its unactuated state, compressed air is once again routed to the sleeve return chamber 850 where it applies a force against the front face 852 of the annular sleeve flange 552. The balance of the forces on the sleeve 510 is such that the sleeve 510 is pushed in a rearward direction until the cap flange seal 516 sealingly engages the front face 866 of the annular exhaust port wall 438. Air in the primary and secondary exhaust chambers 870 and 880 is then vented to the atmosphere in the manner discussed above.

The piston assembly 502, immediately prior to the exhausting of the air in the primary and secondary exhaust chambers 870 and 880, was such that it remained in sealed engagement with the piston bumper 152. When the air in the primary exhaust chamber 870 is vented to the atmosphere, however, the pressure in the frontal air chamber 940 generates a force on the front surface 770 of the piston assembly 502 that exceeds the force that is acting on its rear face 920. As mentioned above, the compensating valve 524 is a one-way valve that prevents air from flowing through the valve apertures 574 and into the hollow cavity 610 and as such, the pressure of the air to the rear of the piston assembly 502 is less than the pressure of the air in the frontal air chamber 940. Accordingly, the pressure acting on the front surface 770 of the piston assembly 502 drives the piston assembly 502 rearwardly until the locking protrusion 744 in the second piston portion 732 engages the groove 490 in the top bumper 424.

Those skilled in the art will understand from this disclosure that while the above-described configuration of the engine assembly 46 results in a relatively lighter-weight tool as compared with pneumatic fastening devices that employ a conventional head valve, the reduction in the weight of the tool 10 does not come at the expense of increased recoil that is felt by the tool operator. In this regard, the felt force that is exerted onto the cap assembly 44 when a fastener F is driven into a workpiece is counteracted by the felt force that is exerted by the sliding of the sleeve 510 in a forward direction.

Magazine Assembly

The magazine assembly 20 is shown to include a magazine body assembly 1000, a follower structure 1002, a follower spring 1004 and a magazine endcap assembly 1006. The magazine body assembly 1000 includes a magazine housing 1010, a pair of guide structures 1012*a* and 1012*b* and a coupling bracket 1014. In the example illustrated, the magazine housing 1010 is extruded from a lightweight material, such as aluminum and includes a wall member 1020 that defines a fastener head portion 1022, a follower housing portion 1024, a pair of guide housing portions 1026 and a fastener body portion 1028.

Figure 21:
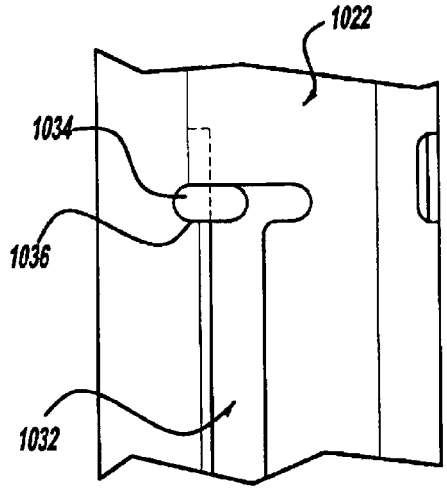
FIG. 21 is a rear view of a portion of the magazine body assembly.

The fastener head portion 1022 is generally rectangular in shape, defining a fastener head chamber 1030 that is open at its top and bottom ends so as to permit the head portion H of the fasteners F to travel through the fastener head portion 1022. The fastener head portion 1022 is also open along a portion of one of its sides 1032 so as to permit the follower structure 1002 to travel upwardly within the magazine housing 1010. With additional reference to FIG. 21, a threaded fastener 1034 is threadably engaged to the wall member 1020, forming a contact surface 1036 that checks the upward travel of the follower structure 1002.

Figure 19:
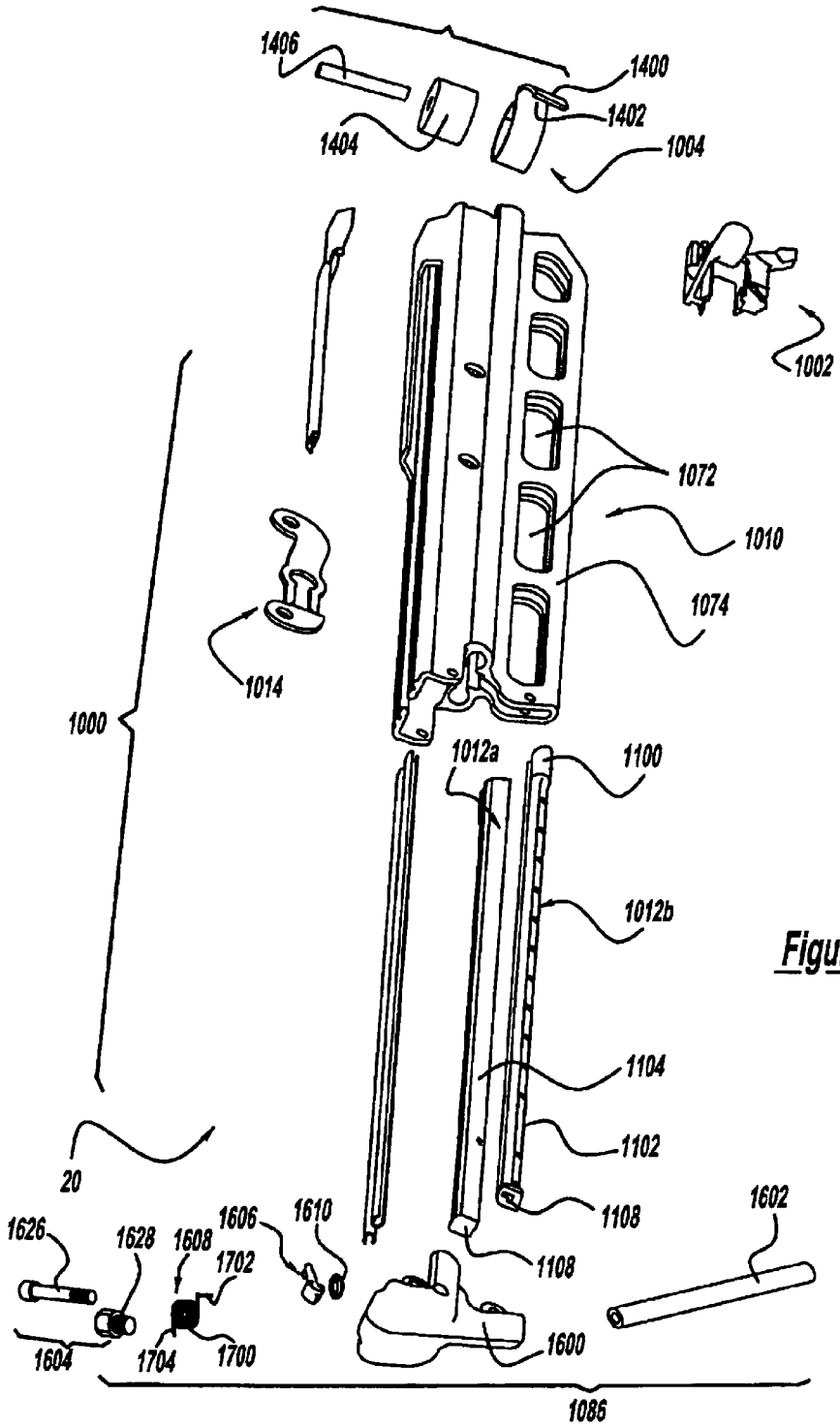
FIG. 19 is an exploded perspective view of the magazine assembly.
Figure 20:
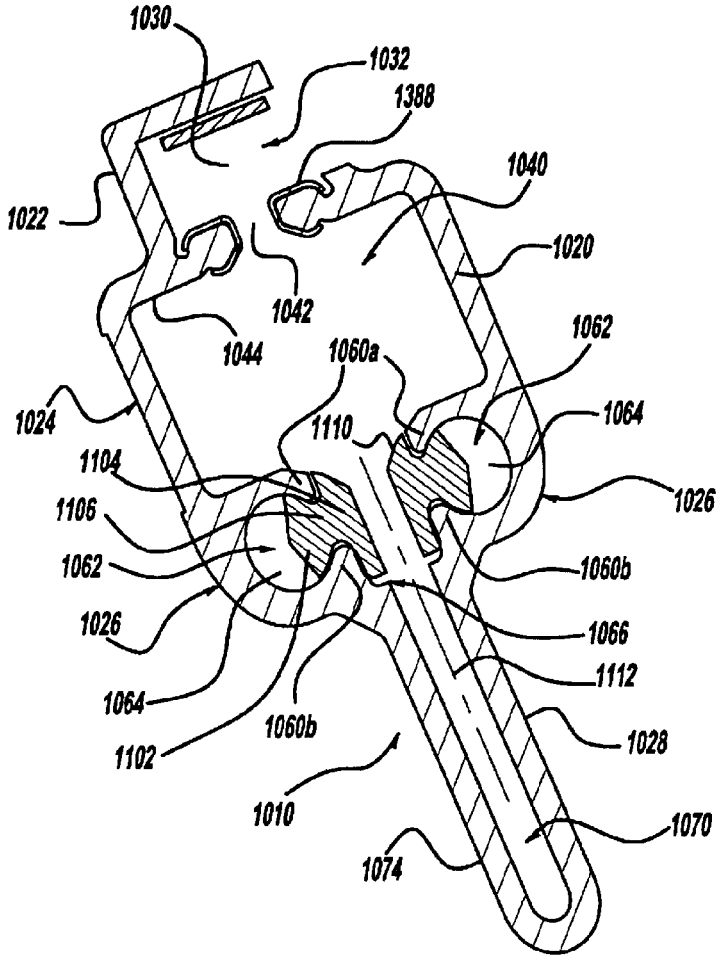
FIG. 20 is a sectional view taken along the line 20—20 of FIG. 1 and illustrating the construction of the magazine body assembly.
Figure 22:
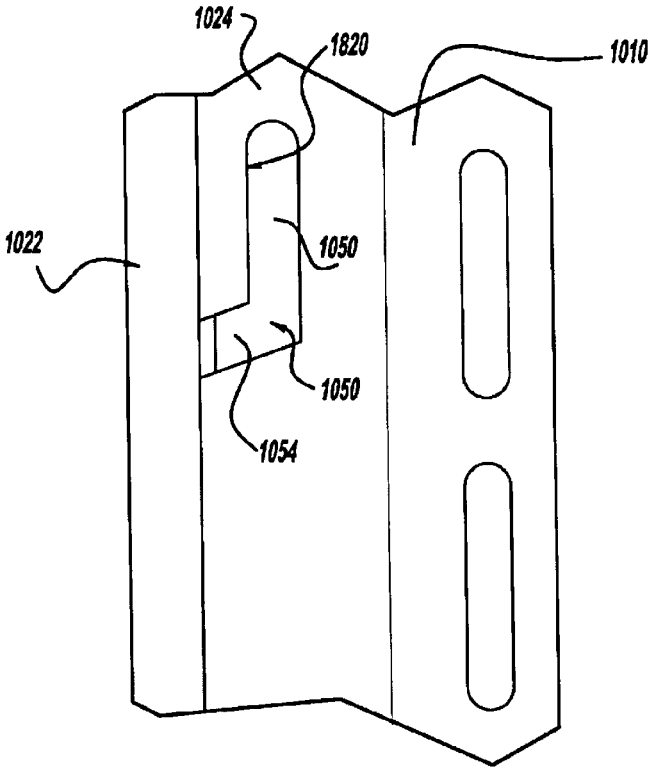
FIG. 22 is a side view of a portion of the magazine body assembly illustrating the L-shaped pin aperture in greater detail.

As shown in FIGS. 19, 20 and 22, the follower housing portion 1024 is coupled to the forward side of the fastener head portion 1022 and defines a generally rectangular follower cavity 1040 that is sized to receive the follower structure 1002 and the follower spring 1004. A slot 1042 is formed into the rear surface 1044 of the follower housing portion 1024. The slot 1042 interconnects the follower cavity 1040 to the fastener head chamber 1030. An L-shaped pin aperture 1050 is formed into a side of the follower housing portion 1024. The L-shaped pin aperture 1050 includes a relatively narrow first portion 1052 that extends generally parallel the longitudinal axis of the follower housing portion 1024 and a second portion 1054 that is skewed to the first portion 1052. The L-shaped pin aperture 1050 will be discussed in greater detail, below.

In FIGS. 19 and 20, each guide housing portion 1026 is shown to include a pair of spaced apart and arcuate protrusions 1060*a* and 1060*b* that are coupled to the wall member 1020. The arcuate protrusions 1060*a* and 1060*b* cooperate with the wall member 1020 to define a guide structure cavity 1062 that extends over the length of the magazine housing 1010 and which is configured to receive one of the guide structures 1012*a* and 1012*b*. In the particular embodiment illustrated, the guide structure cavity 1062 includes a first cavity portion 1064 that is generally cylindrically shaped and located proximate the follower housing portion 1024, and a second cavity portion 1066 that is shaped as a generally flat void that is generally tangent to the cylindrically shaped first cavity portion 1064.

The fastener body portion 1028 is generally U-shaped, being coupled to the forward portion of the pair of guide housing portions 1026. The fastener body portion 1028 includes a U-shaped fastener body cavity 1070 that is configured to receive the body B of the fasteners F. A plurality of oval windows 1072 are formed into the sides 1074 of the fastener body portion 1028 which permit the tool operator to monitor the quantity of fasteners F that are housed in the magazine assembly 20, as well as to reduce the overall weight of the magazine assembly 20.

Figure 23:
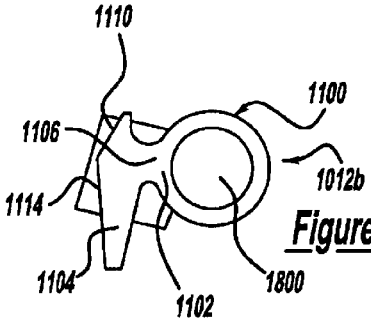
FIG. 23 is a top view of a guide structure.
Figure 26:
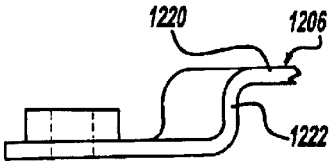
FIG. 26 is a side view of a portion of the bracket structure.

As guide structures 1012*a* and 1012*b* are generally identical in construction, reference numerals may occasionally be shown on only of the guide structure 1012*a* and 1012*b*. Those skilled in the art will understand from this disclosure, however, that guide structure 1012*b* is a mirror image of guide structure 1012*a*. In the embodiment illustrated in FIGS. 19, 20 and 23, each of the guide structures 1012*a* and 1012*b* includes a cylindrically-shaped guide port 1100, first and second retention tabs 1102 and 1104, respectively, an intermediate member 1106 and an end member 1108. The guide port 1100 is generally hollow, having an outside diameter that is sized to slip fit into the first cavity portion 1064 of an associated one of the guide housing portions 1026 and an inside diameter that is to engage an associated one of the magazine guide posts 66. The first retention tab 1102 is coupled to the guide port 1100 on one side and to the intermediate member 1106 on the opposite side. The second retention tab 1104 is coupled to the intermediate member 1106 on the side opposite the first retention tab 1102. The intermediate member 1106 is sized to fit between the arcuate protrusions 1060*a* and 1060*b* in the guide housing portion 1026 as well as to space the first and second retention tabs 1102 and 1104 apart from one another by a predetermined distance that permits the first and second retention tabs 1102 and 1104 to engage the arcuate protrusions 1060*a* and 1060*b* when the guide structures 1012*a* and 1012*b* are inserted into the guide structure cavities 1062. The inner surface 1110 of the second retention tab 1104 extends inwardly further toward the centerline 1112 of the magazine housing 1010 than the inside surfaces of the U-shaped fastener body cavity 1070 so as to form a wear surface 1114 against which the body B of the fastener F is permitted to rub. The end member 1108 is coupled to the end of the guide structures 1012*a* and 1012*b* opposite the end to which the guide port 1100 is coupled. The end member 1108 is configured to abut the ends of the arcuate protrusions 1060*a* and 1060*b* so as to prevent the guide structures 1012*a* and 1012*b* from moving upwardly out of the top of the magazine housing 1010.

Figure 24:
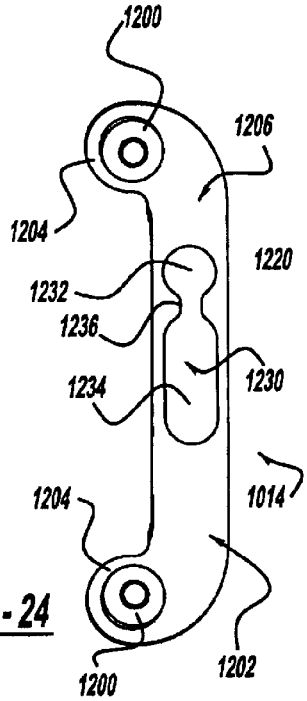
FIG. 24 is a front view of the bracket structure.
Figure 25:
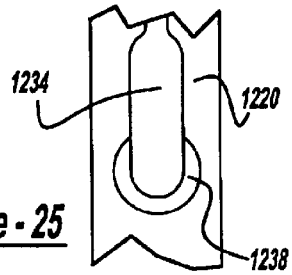
FIG. 25 is a rear view of a portion of the bracket structure.

In FIGS. 24 and 25, the coupling bracket 1014 is shown to have a pair of threaded bushings 1200 and a bracket structure 1202 having a pair of mounting flanges 1204 and a U-shaped body portion 1206 that is coupled to one of the mounting flanges 1204 at each of its opposite ends. Each of the threaded bushings 1200 is coupled to one of the mounting flanges 1204. The mounting flanges 1204 abut the side of the follower housing portion 1024 and threaded fasteners 1210 (FIG. 2) are employed to engage the threaded bushings 1200 to fixedly but removably couple the coupling bracket 1014 to the magazine housing 1010.

The U-shaped body portion 1206 includes a base 1220 and a plurality of legs 1222, with each of the legs 1222 coupling a side of the base 1220 to an associated one of the mounting flanges 1204. The base 1220 includes a slotted pin aperture 1230 that includes a circular portion 1232, a slotted portion 1234 that is spaced apart from the circular portion 1232, and a necked-down slotted portion 1236 having a width that is smaller than that of the slotted portion 1234 and which interconnects the circular and slotted portions 1232 and 1234. The circular portion 1232 is sized to receive the head portion 322 of the clamp pin 300, the slotted portion 1234 is sized to slidingly receive the first body section 324 of the clamp pin 300, and the necked-down slotted portion 1236 is sized to receive the second body section 326 of the clamp pin 300 but not the first body section 324. With specific reference to FIG. 25, the back side of the base 1220 is illustrated in pertinent detail. The end of the slotted portion 1234 is shown to include a conical detent 1238 which is configured to confront the frusto-conical abutting face 330 of the head portion 322 of the clamp pin 300.

With reference to FIGS. 19, 20 and 27 through 32, the follower structure 1002 is illustrated to have a follower body 1300, a front guide tab 1302, a lock-out dog 1304, a loading cam 1306, a follower guide 1308 and an actuating lever 1310. The follower body 1300 is generally U-shaped, having a base 1320 and a pair of follower legs 1322*a* and 1322*b*. The lock-out dog 1304 extends upwardly from the base 1320 in a direction opposite that of the follower legs 1322*a* and 1322*b*. The front guide tab 1302 is also coupled to the base 1320 but extends upwardly and forwardly therefrom in the same plane as the base 1320. Accordingly, when the follower structure 1002 is installed to the magazine housing 1010, the front guide tab 1302 extends forwardly from the follower housing portion 1024, past the pair of guide housing portions 1026 and into the fastener body portion 1028 where the U-shaped tip portion 1330 of the front guide tab 1302 supports the body B of the fasteners F.

The loading cam 1306 is formed into follower leg 1322*a* and includes a first loading cam portion 1350, a second loading cam portion 1352 and an unloading cam portion 1354. The first loading cam portion 1350 is a tapered ramp that extends outwardly and upwardly from the distal end of the follower leg 1322*a*. The second loading cam portion 1352 includes an oval follower capturing portion 1360, a downwardly and forwardly extending intermediate portion 1362 and a forwardly and upwardly extending catch portion 1364 and a catch aperture 1368 that is formed at the lower-most portion of the catch portion 1364. The follower capturing portion 1360 and the intermediate portion 1362 are formed into a first side of the follower leg 1322*a* at a first depth, and the catch portion 1364 is formed into the first side of the follower leg 1322*a* at a second depth that is greater than the first depth. The unloading cam portion 1354 is a generally flat portion of the front surface 1370 of the follower leg 1322*a*.

The follower guide 1308 is formed onto the outside surface of follower leg 1322*b*. The follower guide 1308 includes a V-shaped flange 1380, an end member 1382 and a connector portion 1384 that couples the V-shaped flange 1380 and the end member 1382. The connector portion 1384 is configured to fit into the slot 1042 in the follower housing portion 1024 such that the V-shaped flange 1380 and the end member 1382 confront the rear inside surface 1044 and the rear outside surface 1388, respectively, of the follower housing portion 1024.

The actuating lever 1310 extends outwardly from the end member 1382 and thereafter bends inwardly toward the follower legs 1322*a* and 1322*b*. The distal end of the actuating lever 1310 forms an engagement surface 1390 that is configured for receiving an input from the tool operator's thumb. A protrusion 1392 that is configured to contact the contact surface 1036 in the fastener head portion 1022 is also formed onto the actuating lever 1310.

With reference to FIGS. 19, 20, 29, 30 and 33, the follower spring 1004 is illustrated to include a spring hook 1400, a coiled, flat band spring 1402, a cylindrically-shaped spring roller body 1404 and a spring roller pin 1406. The spring roller pin 1406 extends through and rotatably supports the spring roller body 1404. The band spring 1402 is a type of torsion spring, being coupled to and wound around the spring roller body 1404. The free end of the band spring 1402 is coupled to the spring hook 1400. Each end of the spring roller pin 1406 is set into a generally U-shaped spring roller slot 1410 that is formed into each inside surface of the follower legs 1322*a* and 1322*b* to couple the follower spring 1004 to the follower structure 1002.

When the follower structure 1002 is disposed within the follower housing portion 1024, the band spring 1402 is unwound to permit the C-shaped spring hook 1400 to be engaged to the side of the follower housing portion 1024 opposite the side in which the L-shaped pin aperture 1050 is formed. The torsion exerted by the band spring 1402 is converted to a force that is exerted through the spring roller pin 1406 to the follower structure 1002, thereby biasing the follower structure 1002 in an upward direction toward the spring hook 1400.

In the particular embodiment illustrated in FIGS. 1, 19 and 35 through 45, the magazine endcap assembly 1006 includes a molded end cap structure 1600, a crush tube 1602, a pivot structure 1604, a cam follower 1606, a cam follower spring 1608 and a thrust member 1610. The end cap structure 1600 is configured to mate against the bottom of the magazine housing 1010 to close off the follower housing portion 1024 and the fastener body portion 1028.

The end cap structure 1600 includes a bushing trunnion 1620 for receiving the crush tube 1602, a fastener trunnion 1622 for receiving a fastener 1623*a* (FIG. 1) that couples the nose 1623*b* of the end cap structure 1600 to the fastener body portion 1028 and a pair of pivot trunnions 1624 for receiving the pivot structure 1604, which is illustrated to be a threaded fastener 1626 that is secured to the end cap structure 1600 via a threaded nut 1628 in the example provided. The crush tube 1602, which is retained by the bushing trunnion 1620, prevents the end cap structure 1600 form being overstressed as well as the follower housing portion 1024 from being deformed as a result of the clamping force that is exerted by the threaded fastener 1630 (FIG. 1) that couples the end cap structure 1600 to the follower housing portion 1024.

The end cap structure 1600 also includes a follower directing wall 1640, a thrust flange 1642 and a spring flange 1644. The follower directing wall 1640 extends upwardly from the base 1646 of the end cap structure 1600 and includes a ramped portion 1650, which tapers outwardly and downwardly from the top end 1652 of the follower directing wall 1640, and a generally flat portion 1654 that interconnects the ramped portion 1650 to the base 1646 of the end cap structure 1600. The spring flange 1644 is located proximate one of the pivot trunnions 1624, extending upwardly from the base 1646 of the end cap structure 1600 behind one of the pivot trunnions 1624. The thrust flange 1642 is located between the spring flange 1644 and the follower directing wall 1640 and includes a first U-shaped aperture 1660 that is configured to receive the pivot structure 1604 and a second U-shaped aperture 1662 that is configured to receive the hollow thrust member 1610.

In the particular embodiment illustrated, the cam follower 1606 includes a lever 1670 and a follower hook 1672. The lever 1670 includes a slotted pivot aperture 1680 that is sized to receive and rotate as well as pivot in a lateral (side-to-side) direction on a portion of the pivot structure 1604. The lever 1670 extends beyond the slotted pivot aperture 1680 to form a spring follower hook 1672 that can be employed during the assembly of the magazine endcap assembly 1006. The follower hook 1672 includes a cylindrical body portion 1690 that is coupled to the distal end of the lever 1670 and a leg member 1692 that is coupled to the outer end of the body portion 1690 and which extends downwardly from the body portion 1690 generally parallel to the lever 1670. The outside face 1694 of the leg member 1692 is heavily chamfered such that the leg member 1692 terminates at a rounded tip portion 1696. The intersection between the body portion 1690 and the leg member 1692 is undercut by a radius 1698.

The cam follower spring 1608 is illustrated to be a combination compression and torsion spring having a spring body 1700 that wraps around a portion of the pivot structure 1604, a bent end 1702 for contacting the front face of the lever 1670 and a straight end 1704 for contacting the spring flange 1644. The cam follower spring 1608 is operable for exerting a rotational biasing force onto the cam follower 1606 which biases the cam follower 1606 toward the rear of the tool 10. The cam follower spring 1608 is also operable for exerting a lateral force onto the cam follower 1606 which biases the cam follower 1606 toward the thrust member 1610.

The pivot structure 1604 is positioned through the pivot trunnion 1624 that is adjacent the spring flange 1644. The cam follower spring 1608 is positioned over a portion of the pivot structure 1604 such that the straight end 1704 is in contact with the spring flange 1644. The cam follower 1606 is positioned into the end cap structure 1600 such that the lever 1670 will contact the thrust member 1610 and the follower hook 1672 will be proximate the follower directing wall 1640. The spring follower hook 1672 of the cam follower 1606 is employed to lift the bent end 1702 of the cam follower spring 1608 onto the lever 1670. The pivot structure 1604 is then pushed through the slotted pivot aperture 1680. The hollow thrust member 1610, which is a washer in the embodiment illustrated, is positioned in the second U-shaped aperture 1662 in the thrust flange 1642 and the pivot structure 1604 is pushed entirely through the end cap structure 1600 and secured in place with the threaded nut 1628.

Figure 27:
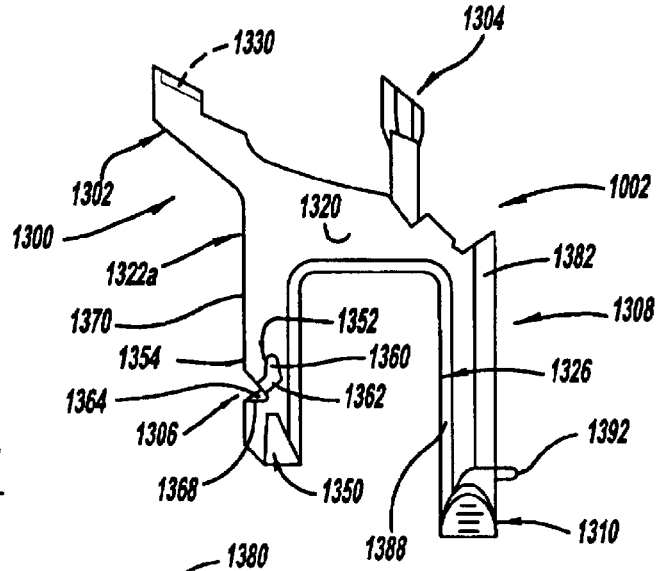
FIG. 27 is a side view of the follower structure.
Figure 28:
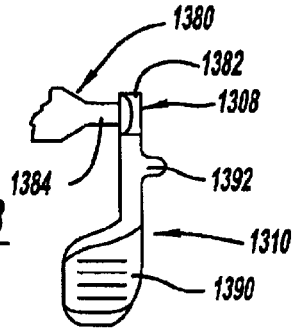
FIG. 28 is a top view of a portion of the follower structure illustrating the construction of a portion of the follower body, the follower guide and the actuating lever.
Figure 29:
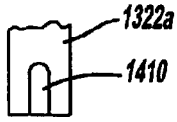
FIG. 29 is a view of a portion of the follower structure illustrating the configuration of the forward leg of the follower body.
Figure 30:
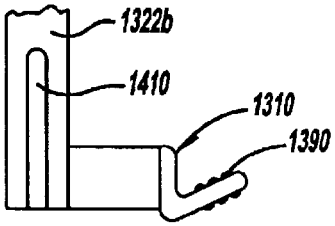
FIG. 30 is a view of a portion of the follower structure illustrating the configuration of the rearward leg of the follower body.
Figure 31:
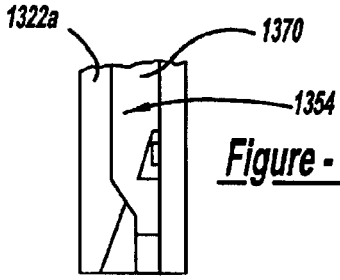
FIG. 31 is a front view of a portion of the follower structure.
Figure 32:
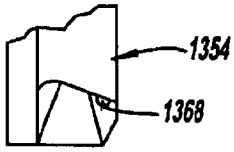
FIG. 32 is a partial view of the follower structure from a side opposite the side which is illustrated in FIG. 27.

With additional reference to FIGS. 27, 31 and 32, when fasteners F are to be loaded into the magazine assembly 20, the tool operator presses the engagement surface 1390 of the actuating lever 1310 to move the follower structure 1002 downward toward the end cap structure 1600. The ramped portion 1650 of the follower directing wall 1640 directs the follower leg 1322*a* of the follower structure 1002 toward the cam follower 1606 and the flat portion 1654 of the follower directing wall 1640 ensures that proper contact is established and maintained between the loading cam 1306 and the cam follower 1606.

Figure 32A:
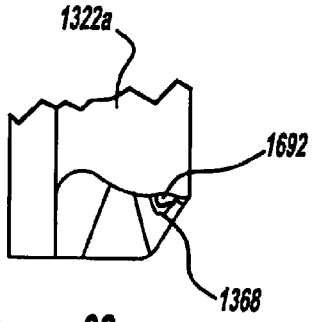
FIG. 32*a* is a view similar to that of FIG. 32 but illustrating the leg of the cam follower engaged into the catch portion of the second loading cam.

When the first loading cam portion 1350 of the loading cam 1306 contacts the leg member 1692 of the follower hook 1672 on the cam follower 1606, the ramp of the first loading cam portion 1350 pushes the follower hook 1672 in a side-to-side motion along the axis of the pivot structure 1604 in the direction of Arrow R (FIG. 43), permitting the leg member 1692 to travel over the first loading cam portion 1350 and into the oval follower capturing portion 1360 of the second loading cam portion 1352 of the loading cam 1306. With the leg member 1692 being positioned in the oval follower capturing portion 1360, the follower structure 1002 cannot be moved further down the magazine housing 1010. When pressure on the engagement surface 1390 of the actuating lever 1310 is released, the force generated by the follower spring 1004 is employed to lift the follower structure 1002 within the magazine housing 1010 so as to simultaneously cause the cam follower 1606 to pivot about the axis of the pivot structure 1604, thereby permitting the leg member 1692 to travel through the intermediate portion 1362 and into the catch portion 1364 of the second loading cam portion 1352 of the loading cam 1306. When the leg member 1692 is positioned in the catch portion 1364 of the loading cam 1306, the leg member 1692 extends through the catch aperture 1368 and around the follower leg 1322*a* of the follower structure 1002 as illustrated in FIG. 32*a*, thereby securely coupling the cam follower 1606 to the follower structure 1002 and inhibiting upward travel of the follower structure 1002 within the magazine housing 1010. In this condition, fasteners F may be readily loaded into the magazine assembly 20.

If the magazine assembly 20 is not already coupled to the fastening tool portion 30, this operation is performed next. This is accomplished by positioning the top end of the magazine assembly 20 relative to the nose assembly 40 such that the holes in the guide ports 1100 are proximate an associated one of the magazine guide posts 66, the stop member 134 on the trigger lever 54 is positioned directly above the first portion 1052 of the L-shaped pin aperture 1050, and the head portion 322 of the clamp pin 300 is engaged to the circular portion 1232 of the slotted pin aperture 1230 in the base 1220 of the bracket structure 1202. The actuating cam 306 is then pushed toward the clamp boss 252 to compress the compression spring 302 and extend the clamp pin 300 in an outward direction so that the second body section 326 of the clamp pin 300 extends through the slotted pin aperture 1230. With the clamp pin 300 in this condition, the magazine assembly 20 is slid upwardly until the clamp pin 300 is fully positioned into the slotted portion 1234 of the slotted pin aperture 1230. Simultaneously, the guide ports 1100 are slid further onto the magazine guide posts 66 so that the top of the magazine assembly 20 cannot pivot relative to the nose assembly 40 and the stop member 134 on the trigger lever 54 is disposed in the second portion 1054 of the L-shaped pin aperture 1050.

Thereafter, the tool operator releases the actuating cam 306, causing the compression spring 302 to retract the clamp pin 300 somewhat so that the first body section 324 of the clamp pin 300 is disposed within the slotted portion 1234 of the slotted pin aperture 1230. In this condition, the parallel flats 328 that are formed onto the first body section 324 abut the parallel sides of the slotted portion 1234 of the slotted pin aperture 1230, thereby permitting the magazine assembly 20 to be slid along an axis defined by the magazine guide posts 66 and the slotted portion 1234 of the slotted pin aperture 1230. The magazine assembly 20 is pushed upwardly into contact with the magazine flange 64 that is formed into the nose structure 50. The actuating cam 306 is then pivoted to place the leg portion 352 in contact with the flat contact surface 344. More specifically, the frusto-conical abutting face 330 of the head portion 322 of the clamp pin 300 engages the conical detent 1238 that is formed into the end of the slotted portion 1234 to both locate the magazine assembly 20 relative to the tool portion 30 as well as to mechanically lock the clamp pin 300 to the coupling bracket 1014.

In this condition, the compression spring 302 exerts a clamping force that is transmitted through the clamp pin 300 to fixedly but removably couple the coupling bracket 1014 to the clamp boss 252. The magazine stabilizing tabs 62 extend downwardly from the magazine flange 64 and abut the opposite sides of the fastener body portion 1028 of the magazine housing 1010 to inhibit excessive rotation of the magazine assembly 20 relative to the nose assembly 40.

With the magazine assembly 20 attached, the fasteners F are fed into the magazine assembly 20 such that the body B of the fasteners F enter the follower cavity 1040 via the slot 1042. Typically, the fasteners F are collated (usually at an angle of 20° or 31°) in "sticks", which permits the magazine assembly 20 to be loaded relatively rapidly.

The follower structure 1002 is released from the cam follower 1606 by pressing downwardly on the engagement surface 1390 of the actuating lever 1310. The body portion 1690 of the follower hook 1672 rides on the upper surface of the forwardly and upwardly extending catch portion 1364, causing the cam follower 1606 to rotate forwardly. The simultaneous downward movement of the follower structure 1002 and the forward rotation of the cam follower 1606 continues until the leg member 1692 slips out of the catch portion 1364 and the body portion 1690 of the follower hook 1672 slides onto the unloading cam portion 1354 of the loading cam 1306. As the leg member 1692 of the follower hook 1672 is not contacting the side of the leg 1322*a* of the follower structure 1002, the follower spring 1004 exerts a force against the lever 1670 that pushes the follower hook 1672 in a side-to-side motion so that the lever 1670 abuts the thrust member 1610. With the body 1690 of the follower hook 1672 engaged against the unloading cam portion 1354 of the loading cam 1306, the body 1690 of the follower hook 1672 prevents the cam follower 1606 from engaging the follower structure 1002 and the upward motion of the follower structure 1002 is controlled by the follower spring 1004. The upward movement of the follower structure 1002 brings the tip portion 1330 of the front guide tab 1302 into contact with the bottom-most fastener F in the magazine assembly 20 which urges the fasteners F upwardly and into the nose assembly 40. The force exerted by the follower structure 1002 onto the fasteners F, along with the configuration of the fastener head portion 1022, ensures that fasteners F will not slip rearwardly out of the magazine assembly 20 during the operation of the tool 10.

As discussed above, the tool operator must push the contact trip 52 against the workpiece to cause the trigger lever 54 to push the secondary trigger 128 in to contact with the trigger valve 130 to permit the state of the trigger valve 130 to be changed. With the magazine assembly 20 fully engaged against the magazine flange 64, the stop member 134 on the trigger lever 54 is free to move in a direction parallel to the longitudinal axis of the tool 10 (i.e., rearwardly-forwardly) within the second portion 1054 of the L-shaped pin aperture 1050.

In the event of a "jam" condition wherein fasteners F have not fed properly through the nose assembly 40, the tool operator need only rotate the actuating cam 306 such that its base portion 350 is abutted against the flat contact surface 344 to release the clamping force that is exerted through the clamp pin 300. The magazine assembly 20 may then be slid downwardly from the magazine flange 64 to permit the tool operator to service the nose assembly 40. The magazine assembly 20, however, is constrained by the magazine guide posts 66 and the clamp pin 300 so that it can only move in a predetermined linear direction. The predetermined linear direction is cooperatively defined by the magazine guide posts 66, which remain engaged in the holes 1800 in the guide ports 1100, and the first body section 324 of the clamp pin 300, which remains engaged in the slotted portion 1234 of the slotted pin aperture 1230. Downward movement of the magazine assembly 20 is checked when the first body section 324 of the clamp pin 300 contacts the necked-down slotted portion 1236 of the slotted pin aperture 1230. Accordingly, the nose assembly 40 may be serviced without completely removing the magazine assembly 20 from the magazine flange 64. Furthermore, when the magazine assembly 20 is moved downwardly into this condition, the stop member 134 is moved out of the second portion 1054 of the L-shaped pin aperture 1050 and into the first portion 1052 of the L-shaped pin aperture 1050. With the stop member 134 located in this manner, rearward motion of the contact trip 52 relative to the nose body 60 is limited such that the stop member 134 contacts the rearward edge 1820 of the first portion 1052 of the L-shaped pin aperture 1050, thereby preventing the trigger lever 54 from pushing the secondary trigger 128 sufficiently rearward so that the state of the trigger valve 130 cannot be changed (i.e., actuated). Accordingly, the stop member 134 and the L-shaped pin aperture 1050 cooperate to selectively prevent the trigger valve 130 from being actuated depending upon the position of the magazine assembly 20 relative to the magazine flange 64.

Those skilled in the art will understand from this disclosure that as fasteners F are dispensed from the tool 10, the follower spring 1004 will force the follower structure 1002 in an upwardly direction so as to continue to feed fasteners F into the nose body 60. When the magazine assembly 20 is empty of fasteners F, the follower structure 1002 will be raised within the magazine housing 1010 to a point wherein the lock-out dog 1304 extends through the lock-out dog aperture 90 that is formed into the magazine flange 64 so that it inhibits sufficient rearward motion of the contact trip 52 so as to prevent the trigger lever 54 from changing the state of the trigger valve 130. Accordingly, the lock-out dog 1304 inhibits the tool 10 from cycling when the magazine assembly 20 is empty of fasteners F and coupled to the magazine flange 64.

Figure 46:
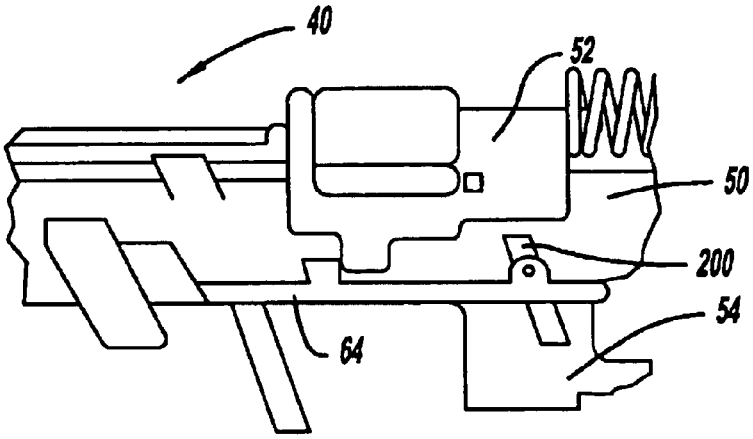
FIG. 46 is a side view of a portion of a tool constructed in accordance with the teachings of the an alternate embodiment of the present invention illustrating the magazine assembly removed from the tool.
Figure 47:
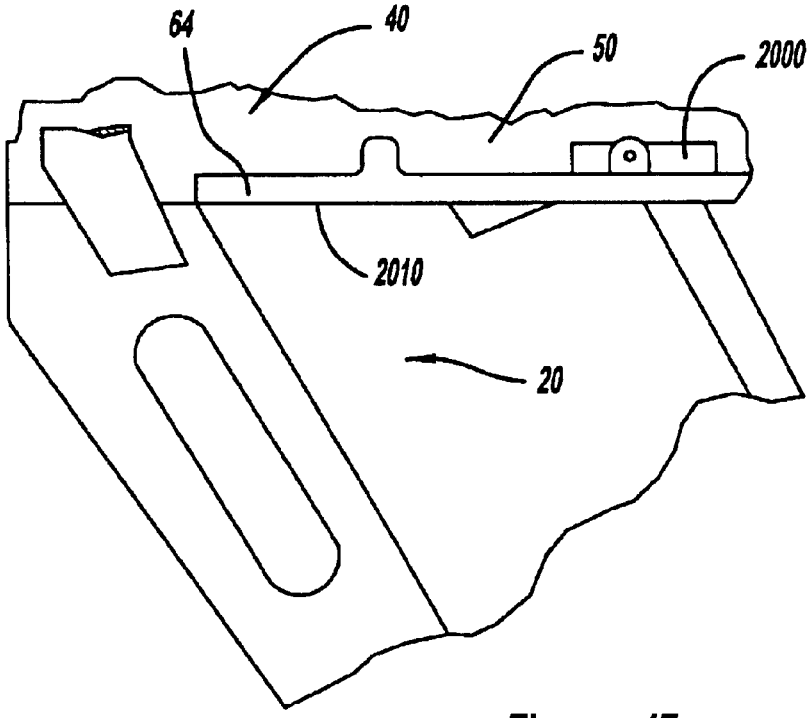
FIG. 47 is a side view similar to that of FIG. 46 but illustrating the magazine assembly coupled to the tool.

In an alternate embodiment of the present invention illustrated in FIGS. 46 and 47, the nose assembly 40 includes a pivoting lock-out tab 2000 that is rotatably coupled to the nose structure 50 and pivotable between a first position, which is illustrated in FIG. 47, that permits the contact trip 52 to move rearwardly a sufficient amount that permits the trigger lever 54 to change the state of the trigger valve 130, and a second position, which is shown in FIG. 46, that inhibits rearward motion of the contact trip 52 by an amount wherein the trigger lever 54 cannot change the state of the trigger valve 130. As illustrated in FIG. 47, when the magazine assembly 20 abuts the magazine flange 64, the top surface 2010 of the magazine housing 1010 contacts the lock-out tab 2000 and rotates it into the first position. When the magazine assembly 20 is not abutted against the magazine flange 64 as illustrated in FIG. 46, however, the lock-out tab 2000 is rotated by a torsion spring (not specifically shown) into the second position to prevent the tool 10 from being cycled.

Figure 9A:
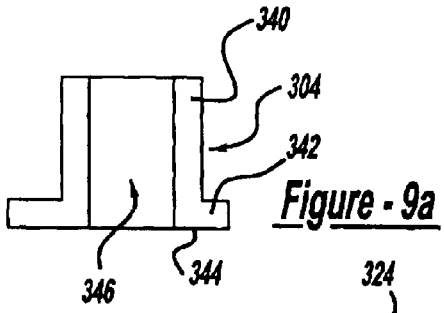
FIG. 9*a* is sectional view of a portion of the magazine clamp assembly illustrating the spring collar in greater detail.
Figure 9B:
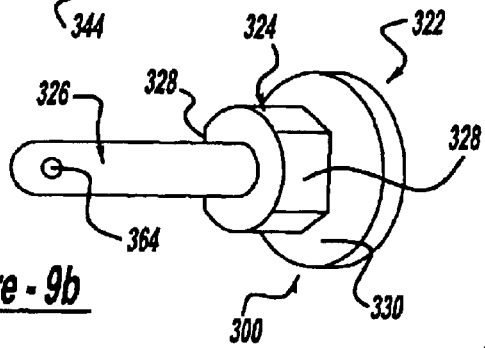
FIG. 9*b* is a perspective view of a portion of the magazine clamp assembly illustrating the clamp pin in greater detail.
Figure 9:
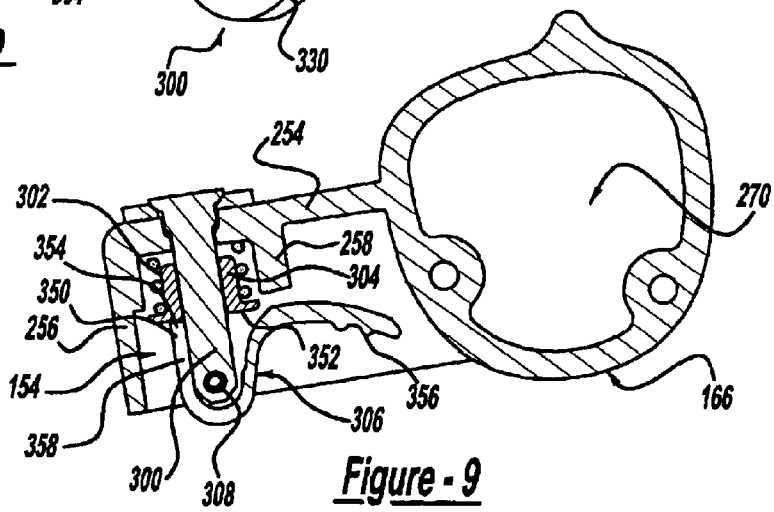
FIG. 9 is a sectional view taken along the line 9—9 of FIG. 2.
Figure 49:
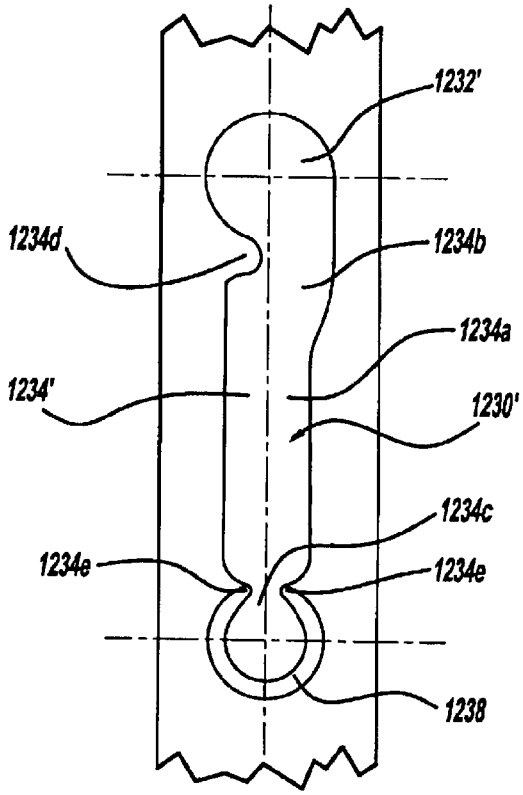
FIG. 49 is a partial front view similar to that of FIG. 24 but illustrating a bracket structure having an alternately constructed slotted pin aperture.
Figure 48:
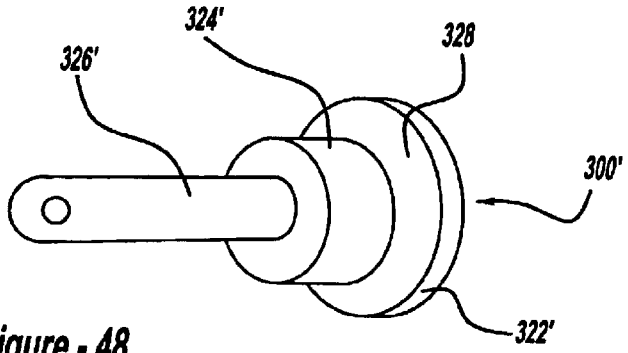
FIG. 48 is a perspective view similar to that of FIG. 9*b* but illustrating an alternately constructed clamp pin.
Figure 33:
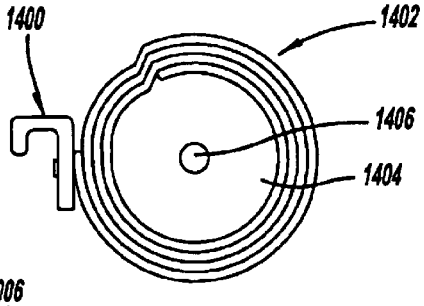
FIG. 33 is a side view of the follower spring.
Figure 34:
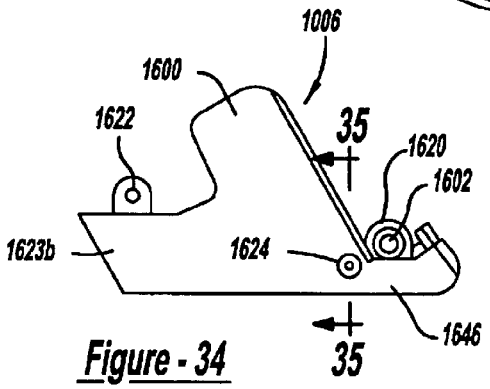
FIG. 34 is a side view of the magazine end cap assembly.
Figure 35:
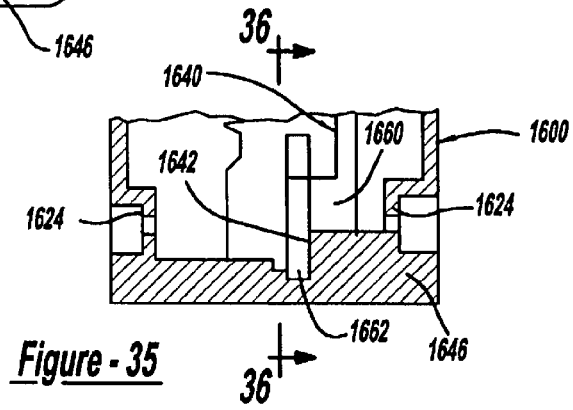
FIG. 35 is a sectional view of a portion of the end cap structure taken along the line 35—35 in FIG. 34.
Figure 36:
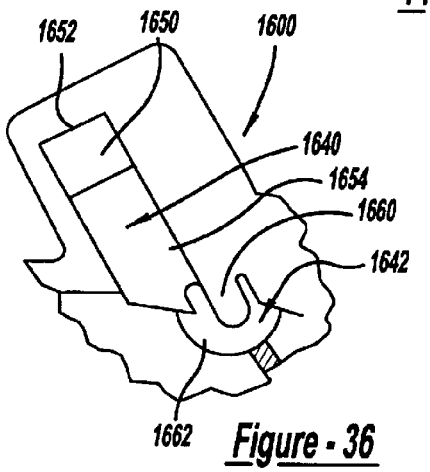
FIG. 36 is a sectional view of a portion of the end cap structure taken along the line 36—36 in FIG. 35.
Figure 37:
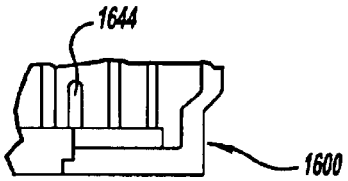
FIG. 37 is a top view of a portion of the end cap structure.
Figure 38:
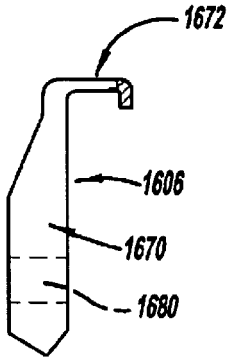
FIG. 38 is a front view of the cam follower.
Figure 39:
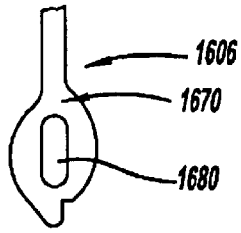
FIG. 39 is a partial side view of the cam follower.
Figure 40:
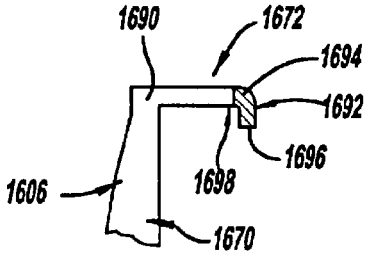
FIG. 40 is an enlarged portion of the cam follower illustrated in FIG. 38.
Figure 41:
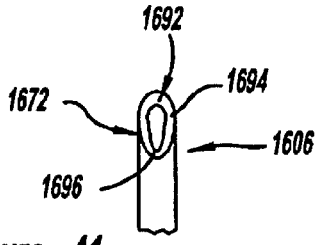
FIG. 41 is a partial side view of the cam follower illustrating the follower hook in greater detail.
Figure 42:
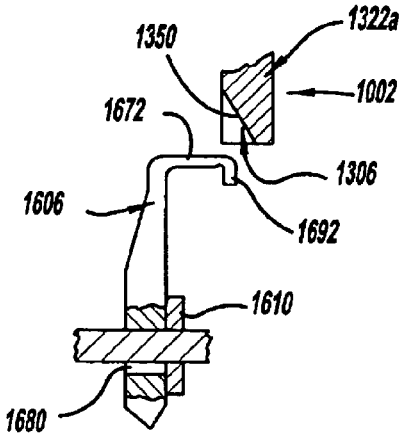
FIG. 42 is a partial section view illustrating the position of the cam follower on the pivot structure just prior to contact between the loading cam and the follower hook.
Figure 43:
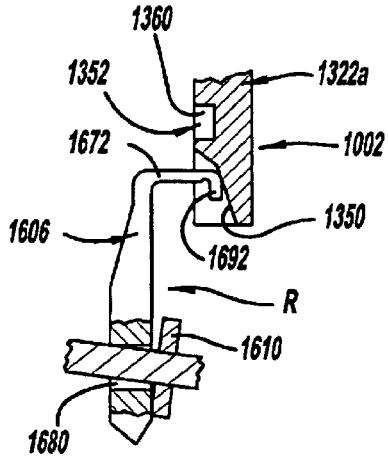
FIG. 43 is a partial section view similar to that of FIG. 42 but illustrating the cam follower when the follower hook is contacting the first loading cam portion.
Figure 44:
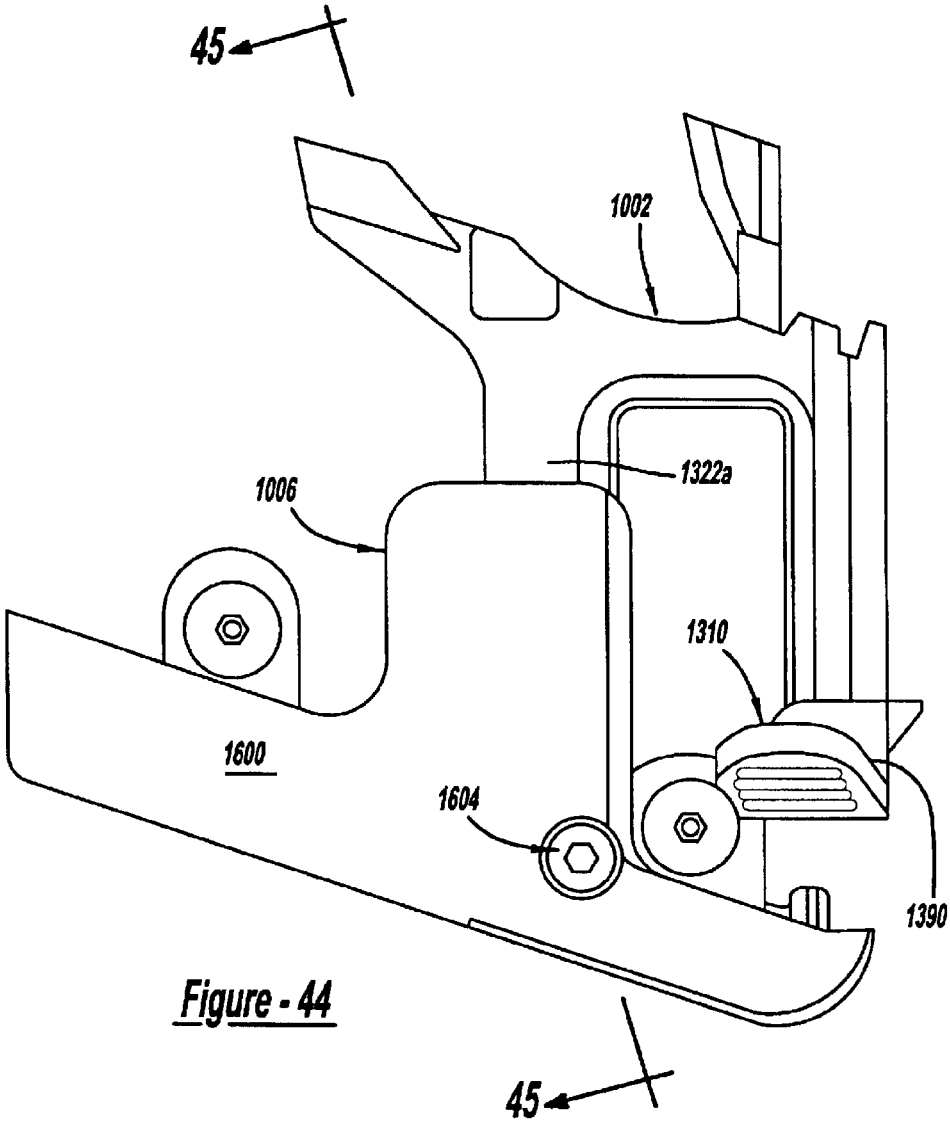
FIG. 44 is a side view of the follower structure engaged to the magazine end cap assembly.
Figure 45:
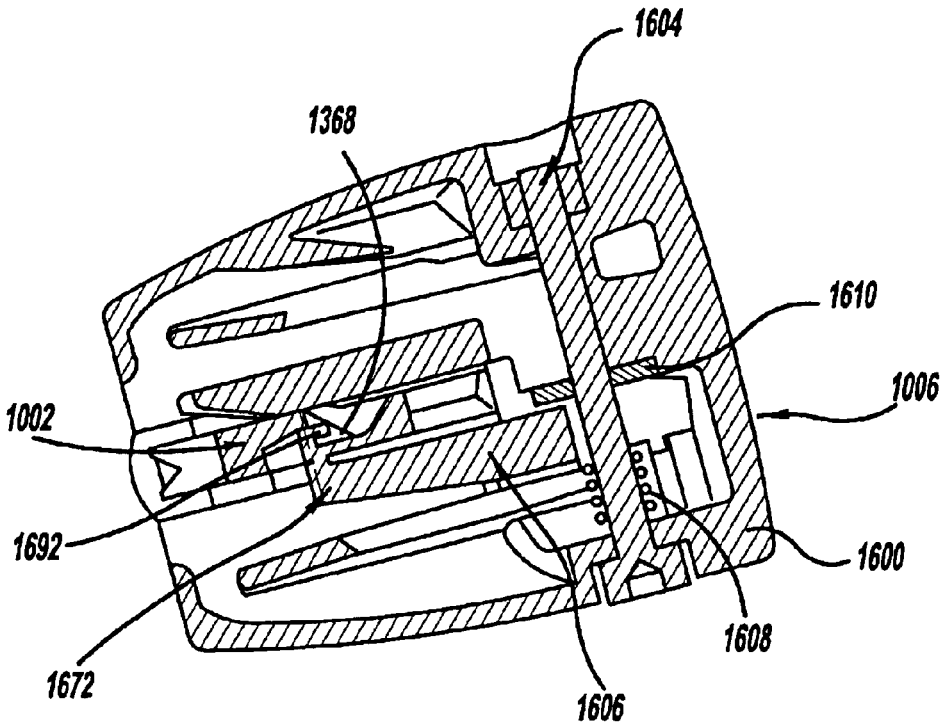
FIG. 45 is a section view taken along the line 45—45 illustrating the follower hook disposed within the capture aperture.

Those skilled in the art will understand from this disclosure that the configuration of the slotted pin aperture and the clamp pin may be somewhat different from that which is shown in FIGS. 9*b* and 24. For example, the clamp pin and the slotted pin aperture may be formed as is illustrated in FIGS. 48 and 49, respectively. In this embodiment, the clamp pin 300' is substantially identical to the clamp pin 300 except for the omission of the parallel flats 328 from the first body section 324'.

The configuration of the slotted pin aperture 1230', however, is substantially different from the configuration of the slotted pin aperture 1230. In this regard, the slotted pin aperture 1230' includes a circular portion 1232', which is sized to receive the head 322' of the clamp pin 300' therethrough, and a slotted portion 1234', which has a body portion 1234*a* with a first end 1234*b* and a second end 1234*c*. The first end 1234*b* interconnects the body portion 1234*a* to the circular portion 1232' in a dog-legged manner. In this regard, the first end 1234*b* defines a protrusion 1234*d* that necessitates that the coupling bracket 1014' and the clamp pin 300' be moved laterally relative to one another to permit the clamp pin 300' to move around the protrusion 1234*d* and into the circular portion 1232'. The first end 1234*b* and the protrusion 1234*d* may be sized so as to permit the first body section 324' of clamp pin 300' to pass around the dog-leg and into the circular portion 1232', or, as is presently preferred may be sized to allow only permit the second body section 326' of the clamp pin 300' to pass around the dog-leg and into the circular portion 1232'. The second end 1234*c* of the body portion 1234*a* is similar in configuration to the end of the slotted portion 1234, in that it includes a conical detent 1238. The second end 1234*c*, however, defines one or more protrusions 1234*e* which are relatively narrower than the body portion 1234*a* so as to admit therethrough only the second body section 326' of the clamp pin 300'.

This alternate construction of the clamp pin 300' and the coupling bracket 1014' is advantageous in that it simplifies the construction of the clamp pin 300' (relative to the clamp pin 300), and renders the connection between the clamp pin 300' and the coupling bracket 1014' more secure.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the, specification as the best mode presently contemplated for carrying out this invention, but that the invention will include any embodiments falling within the foregoing description and the appended claims.

What is claimed is:

1. A magazine assembly for a fastening tool, the magazine assembly comprising:

a magazine housing defining a follower housing portion with an upper end and a lower end;

a follower structure at least partially disposed in the follower housing portion;

a spring associated with the magazine housing and the follower structure, the spring biasing the follower structure upwardly toward the upper end of the follower housing portion;

a catch having a first catch portion, which is associated with the follower structure, and a second catch portion, which is associated with the magazine housing, the catch being selectively operable in an engaged condition that maintains the follower structure in a predetermined position relative to the magazine housing, wherein the catch is situated in the engaged condition in response to manually releasing the follower structure following an initial downwardly directed contact event to thereby permit the spring to bias the follower structure upwardly in the follower housing portion; and wherein the catch is changed from the engaged condition to an unengaged condition in response to a subsequent downwardly directed contact event.

2. The magazine assembly of claim 1, wherein the first catch portion includes a loading cam and the second catch portion includes a follower hook, the follower hook extending around a portion of the loading cam when the catch is engaged.

3. The magazine assembly of claim 2, wherein contact between the loading cam and the follower hook during the initial downwardly directed contact event causes the follower hook to translate in a first direction that is generally perpendicular to a feed direction of the fasteners.

4. The magazine assembly of claim 3, wherein contact between the loading cam and the follower hook immediately following the initial downwardly directed contact event causes the follow hook to both translate in a direction opposite the first direction and pivot about a pivot axis.

5. The magazine assembly of claim 2, wherein contact between the loading cam and the follower hook during the subsequent downwardly directed contact event causes the follower hook to pivot about a pivot axis.

6. The magazine assembly of claim 2, wherein the second catch portion further comprises an end cap that covers at least a portion of the lower end of the follower housing portion.

7. The magazine assembly of claim 6, wherein at least one follower spring biases the follower hook in a predetermined rotary direction about an axis as well as in a predetermined direction along the axis.

8. The magazine assembly of claim 7, wherein the follower spring is a combination compression and torsion spring.

9. The magazine assembly of claim 1, wherein the follower structure includes an actuating lever and a follower body.

10. The magazine assembly of claim 9, wherein the spring includes a flat band spring and a pin, the band spring being wound about the pin, the pin being supported by the follower body.

11. The magazine assembly of claim 10, wherein the follower body includes a pair of spaced-apart legs and the pin extends between and is supported by the spaced-apart legs.

12. The magazine assembly of claim 11, wherein each on the spaced-apart legs includes a roller slot into which an associated end of the pin is disposed.

13. The magazine assembly of claim 11, wherein the first catch portion is formed on a first one of the spaced-apart legs and the actuating lever is coupled to the other one of the spaced-apart legs.

14. A fastening tool assembly comprising:

a fastening tool; and a magazine assembly associated with the fastening tool, the magazine assembly being configured to hold and progressively dispense a plurality of fasteners, the magazine assembly including a magazine housing, a follower structure, a spring and a catch, the magazine housing having a follower housing portion with an upper end and a lower end, the follower structure including a follower body and an actuating lever, the follower body being at least partially disposed in the follower housing portion, the actuating lever extending from the magazine housing and being configured to receive a manual input from a finger of a user, the manual input being configured to translate the follower body downwardly in the follower housing portion, the spring being associated with the magazine housing and the follower structure and configured to bias the follower structure upwardly toward the upper end of the follower housing portion, the catch including a first catch portion that is coupled to the follower body and a second catch portion that is associated with the magazine housing, the catch being operable in an unlatched condition, which does not inhibit upward translating movement of the follower structure relative to the magazine housing, and a latched condition in which the first and second catch portions engage one another to inhibit the follower body from moving upwardly in the follower housing portion;

wherein the user need only press the actuating lever downward to cause the follower structure to translate downward relative to the magazine housing beyond a predetermined point and thereafter release the actuating lever to change the catch from the latched condition to the unlatched condition.

15. The fastening tool assembly of claim 14, wherein the fastening tool is a nailer.

16. The fastening tool assembly of claim 15, wherein the fastening tool is pneumatically operated.

17. The fastening tool assembly of claim 14, wherein the follower body includes a downwardly extending leg to which the first catch portion is coupled.

18. The fastening tool assembly of claim 17, wherein the first catch portion includes a groove that is formed in the leg of the follower body, the leg cooperating with the second catch portion to limit an amount by which the follower body may be translated toward the lower end of the magazine housing prior to situating the catch in the latched condition.

19. The fastening tool assembly of claim 18, wherein the first catch portion further includes a catch aperture for receiving a portion of the second catch portion, the catch aperture being formed below the groove, wherein receipt of the portion of the second catch portion into the catch aperture inhibits movement of the follower body in an upward direction relative to the magazine housing.

20. The fastening tool assembly of claim 19, wherein the portion of the second catch portion is a follower hook.

21. The fastening tool assembly of claim 19, wherein the first catch portion further includes a tapered ramp that extends outwardly and upwardly from a distal end of the leg, the tapered ramp being configured to push the portion of the second catch portion such that it passes along a side of the leg when the first and second catch portions contact one another prior to the catch being situated in the latched condition.

22. The fastening tool assembly of claim 19, wherein the first catch portion further includes an unloading cam that is formed on a side of the leg adjacent a side on which the groove is formed.

23. The fastening tool assembly of claim 22, wherein the unloading cam includes a generally vertical surface of the leg, a downwardly skewed surface and an upwardly skewed surface, the downwardly skewed surface and the upwardly skewed surface intersecting one another to form a generally V-shaped notch in the generally vertical surface of the leg.

24. The fastening tool assembly of claim 23, wherein translation of the follower body toward the lower end of the magazine housing after the catch has been situated in the latched condition brings the upwardly skewed surface into contact with the portion of the second catch portion to thereby pivot the portion of the second catch portion in a direction away from the leg of the follower body.

25. A fastening tool assembly comprising:

a fastening tool; and a magazine assembly associated with the fastening tool, the magazine assembly being configured to hold and progressively dispense a plurality of fasteners, the magazine assembly including a magazine housing, a guide tab, a first catch portion, a second catch portion and a spring, the magazine housing being configured to hold the fasteners and having a follower housing portion with an upper end and a lower end, the guide tab being at least partially housed in the magazine housing and being configured to guide the fasteners while they are being progressively dispensed from the magazine housing, the first catch portion being coupled to one of the magazine housing and the follower structure, the second catch portion being coupled to the other one of the magazine housing and the follower structure, the spring biasing at least one of the first catch portion and the second catch portion away from the other one of the first catch portion and the second catch portion;

wherein the first catch portion and the second catch portion cooperate with one another to permit the guide tab to be latched in a loading position whereby the fasteners may be loaded into the magazine housing, the first catch portion and the second catch portion being configured such that engagement of the first catch portion and the second catch portion is effected through relative translation of one of the first catch portion and the second catch portion toward the other one of the first catch portion and the second catch portion followed by relative translation of the one of the first catch portion and the second catch portion away from the other one of the first catch portion and the second catch portion; and wherein the first catch portion and the second catch portion being further configured such that disengagement of the first catch portion and the second catch portion from one another is effected solely through translation of the one of the first catch portion and the second catch portion toward the other one of the first catch portion and the second catch portion followed by relative translation of the one of the first catch portion and the second catch portion away from the other one of the first catch portion and the second catch portion.

26. The fastening tool assembly of claim 25, wherein the first catch portion includes a groove that is formed in the leg of the follower body, the leg cooperating with the second catch portion to limit an amount by which the follower body may be translated toward the lower end of the magazine housing prior to situating the catch in the latched condition.

27. The fastening tool assembly of claim 26, wherein the first catch portion further includes a catch aperture for receiving a portion of the second catch portion, the catch aperture being formed below the groove, wherein receipt of the portion of the second catch portion into the catch aperture inhibits movement of the follower body in an upward direction relative to the magazine housing.

28. The fastening tool assembly of claim 27, wherein a lower surface of the groove slopes toward the catch aperture.

29. The fastening tool assembly of claim 27, wherein the portion of the second catch portion is a follower hook.

30. The fastening tool assembly of claim 27, wherein the first catch portion further includes a tapered ramp that extends outwardly and upwardly from a distal end of the leg, the tapered ramp being configured to push the portion of the second catch portion such that it passes along a side of the leg when the first and second catch portions contact one another prior to the catch being situated in the latched condition.

31. The fastening tool assembly of claim 30, wherein the first catch portion further includes an unloading cam that is formed on a side of the leg adjacent a side on which the groove is formed.

32. The fastening tool assembly of claim 31, wherein the unloading cam includes a generally vertical surface of the leg, a downwardly skewed surface and an upwardly skewed surface, the downwardly skewed surface and the upwardly skewed surface intersecting one another to form a generally V-shaped notch in the generally vertical surface of the leg.

33. The fastening tool assembly of claim 32, wherein translation of the follower body toward the lower end of the magazine housing after the catch has been situated in the latched condition brings the upwardly skewed surface into contact with the portion of the second catch portion to thereby pivot the portion of the second catch portion in a direction away from the leg of the follower body.

34. The fastening tool assembly of claim 25, wherein the first catch portion includes a loading cam and the second catch portion includes a follower hook, the follower hook extending around a portion of the loading cam when the catch is engaged.

35. The fastening tool assembly of claim 34, wherein contact between the loading cam and the follower hook when the one of the first catch portion and the second catch portion is undergoing relative translation toward the other one of the first catch portion and the second catch portion prior to engagement of the first and second catch portions causes the follower hook to translate in a first direction that is generally perpendicular to a feed direction of the fasteners.

36. The fastening tool assembly of claim 35, wherein contact between the loading cam and the follower hook when the one of the first catch portion and the second catch portion is undergoing relative translation away from the other one of the first catch portion and the second catch portion immediately prior to effecting engagement of the first and second catch portions causes the follow hook to both translate in a direction opposite the first direction and pivot about a pivot axis.

37. The fastening tool assembly of claim 34, wherein contact between the loading cam and the follower hook to effect disengagement of the first and second catch portions causes the follower hook to pivot about a pivot axis.

38. A fastening tool assembly comprising:

a fastening tool; and a magazine assembly associated with the fastening tool, the magazine assembly being configured to hold a plurality of fasteners and progressively dispense the fasteners, the magazine assembly including a magazine housing, a guide tab movably disposed in the magazine housing and a catch for selectively securing the guide tab relative to the magazine housing in a loading position that permits one or more fasteners to be loaded into the magazine housing, wherein the catch is solely responsive to translation of the guide tab within the magazine housing to latch the guide tab into the loading position and unlatch the guide tab from the loading position.

39. The fastening tool assembly of claim 38, wherein a movement consisting of a downwardly directed movement of the guide tab followed by an upwardly directed movement of the guide tab is required to unlatch the guide tab from the loading position.

40. The fastening tool assembly of claim 39, wherein a movement consisting of a downwardly directed movement of the guide tab followed by an upwardly directed movement of the guide tab is required to latch the guide tab into the loading position.

41. The fastening tool assembly of claim 38, wherein a movement consisting of a downwardly directed movement of the guide tab followed by an upwardly directed movement of the guide tab is required to latch the guide tab into the loading position.

42. A method for operating a fastening tool assembly having a fastening tool and a magazine assembly, the magazine assembly including a magazine housing, a guide tab, a spring and a catch, the guide tab being at least partially disposed in the magazine housing, the spring being operable for biasing the guide tab upwardly in the magazine housing, the catch being operable in an engaged condition for holding the guide tab in a position that permits a plurality of fasteners to be loaded into the magazine housing, the catch being further operable in a disengaged condition that does not inhibit upward movement of the guide tab in the magazine housing, the method comprising:

pushing the guide tab to a predetermined point at a lower end of the magazine housing;

releasing the guide tab so that the spring lifts the guide tab upwardly from the predetermined point to engage the catch;

loading the plurality of fasteners into the magazine housing;

pushing the guide tab toward the lower end of the magazine housing to disengage the catch; and releasing the guide tab to permit the spring to raise the guide tab toward the upper end of the magazine housing.

* * * * *